US011597552B1

(12) United States Patent
Hoffman et al.

(10) Patent No.: US 11,597,552 B1
(45) Date of Patent: Mar. 7, 2023

(54) RIGHT-SIZED THERMOFORMED CAVITIES FOR PACKAGING ITEMS

(71) Applicant: Amazon Technologies, Inc., Seattle, WA (US)

(72) Inventors: Brian Stuart Hoffman, Seattle, WA (US); Cory Richard Boudreau, Madison, WI (US); Todd Ethan Brunner, Madison, WI (US); David C. Franchino, Madison, WI (US); Alexandra Kay Hartford, Seattle, WA (US); Vivian Lin, Madison, WI (US); Mohan Mahadevan, Seattle, WA (US); John Gaetano Matrecano, Sammamish, WA (US); Alexandra Surasky-Ysasi, Madison, WI (US); Timothy Alan Talda, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 192 days.

(21) Appl. No.: 16/881,562

(22) Filed: May 22, 2020

Related U.S. Application Data

(63) Continuation of application No. 15/925,676, filed on Mar. 19, 2018, now Pat. No. 10,669,054.

(51) Int. Cl.
*B65B 5/02* (2006.01)
*B65B 35/24* (2006.01)
(Continued)

(52) U.S. Cl.
CPC ..... *B65B 47/00* (2013.01); *B65B 5/02* (2013.01); *B65B 35/24* (2013.01); *B65B 43/42* (2013.01);
(Continued)

(58) Field of Classification Search
CPC ..... B65B 47/00; B65B 5/02; B65B 35/24; B65B 57/00; B65B 43/42; B65B 61/005;
(Continued)

(56) References Cited

U.S. PATENT DOCUMENTS 6,398,992 B1 * 6/2002 Jacobson ..... B29C 33/3821 264/108
6,986,855 B1 * 1/2006 Hood ..... B29C 33/44 264/219
(Continued)

*Primary Examiner* — Robert F Long
*Assistant Examiner* — Xavier A Madison
(74) *Attorney, Agent, or Firm* — Athorus, PLLC

(57) ABSTRACT

An actuator system for fabricating a cavity within thermoplastic material includes a plurality of actuators arranged in an array. When dimensions of an item are determined, the actuator system may be programmed with data regarding such dimensions to fabricate a cavity for the item. A subset of the actuators, and distances by which each of the actuators is to be extended, may be selected based on dimensions of the item, in order to fabricate a cavity within the thermoplastic material that may accommodate the item therein. Additionally, the actuators and the distances may be selected based on intrinsic or extrinsic data regarding the item, and a cavity fabricated within the thermoplastic material may include one or more buffer zones or protective regions that are specifically formed with respect to aspects of the item.

20 Claims, 25 Drawing Sheets

(51) Int. Cl.

| | |
|---|---|
| ***B65B 47/00*** | (2006.01) |
| ***B65B 61/00*** | (2006.01) |
| ***B65B 57/00*** | (2006.01) |
| ***B65B 43/42*** | (2006.01) |
| ***B65B 47/02*** | (2006.01) |
| ***B65B 47/04*** | (2006.01) |

(52) U.S. Cl.
CPC ..... *B65B 47/02* (2013.01); *B65B 47/04* (2013.01); *B65B 57/00* (2013.01); *B65B 61/005* (2013.01)

(58) Field of Classification Search
CPC ..... B65B 57/12; B65B 11/52; B65B 31/028; B65B 41/12; B65B 35/10; B65B 47/02
USPC ..... 53/452, 453
See application file for complete search history.

(56) References Cited

U.S. PATENT DOCUMENTS

| | | | | |
|---|---|---|---|---|
| 7,159,836 | B2 * | 1/2007 | Parks | B29C 43/36 249/155 |
| 7,172,714 | B2 * | 2/2007 | Jacobson | B29C 33/3821 264/108 |
| 9,168,678 | B2 | 10/2015 | Kristensen et al. | |
| 10,343,802 | B1 | 7/2019 | Wu | |
| 2007/0290389 | A1 * | 12/2007 | Younie | B29C 33/3821 264/220 |
| 2010/0181698 | A1 * | 7/2010 | Berger | B29C 39/42 264/219 |
| 2016/0159510 | A1 | 6/2016 | Lau et al. | |
| 2016/0345437 | A1 | 11/2016 | Heikkinen et al. | |
| 2018/0207839 | A1 | 7/2018 | Isse | |

* cited by examiner

RIGHT-SIZED THERMOFORMED CAVITIES FOR PACKAGING ITEMS

CROSS-REFERENCE TO RELATED APPLICATIONS

This application is a continuation of U.S. patent application Ser. No. 15/925,676, filed Mar. 19, 2018, now U.S. Pat. No. 10,669,054, the contents of which are incorporated by reference herein in their entirety.

BACKGROUND

Contemporary online marketplaces are able to offer a wide variety of groups or types of items (including goods, services, information and/or media of any type or form) to customers who may be located in virtually any area of the globe, in any number of ways. Such items may be delivered to a fulfillment center or other facility operated by the online marketplace by one or more sellers, vendors, manufacturers or other sources. When a customer places an order for one or more of the items, the online marketplace may package the item for delivery to the customer, process any necessary transactions, and arrange for the items to be delivered to the customer.

Within a modern fulfillment center environment, items that have been ordered by customers are typically delivered to the customers, or to destinations specified by such customers, according to one or more general methods. For example, an ordered item may be retrieved from a designated storage location and transported to a workstation where the item is to be prepared for delivery. Upon an arrival of the ordered item at the workstation, the item may be recognized by one or more manual or automatic means, such as by scanning or reading an external marking, label or other identifier on an outer surface of the item, by recognizing a data transfer device associated with the item or the vehicle in which it is transported, or by determining a mass of the item.

Once an ordered item has been identified, a set of instructions for preparing the ordered item for delivery may be determined and provided to a worker, e.g., on paper, or on at least one monitor or other computer display, and such instructions may be of any kind or take any form. For example, the instructions may identify a container (e.g., a box, a bag, a tube, an envelope) into which the ordered item is to be placed, along with an amount and type of dunnage (e.g., paper, plastic, foam materials or "bubble wrap"), a means of transit by which the container is to be delivered (e.g., a common carrier, the United States Postal Service, or a customized or specialized means of transit), as well as a destination for the container. Additionally, the instructions may be intrinsic to the ordered item itself. For example, an instruction may direct a worker to affix a label or decal on heavy or large items, to include a gift card or order description (e.g., packing slip) in a container with the ordered item, or to take any other specific action based on one or more attributes of the ordered item.

The processes of selecting containers and dunnage may be substantial drivers of the costs or time required in order to deliver such items. For example, while containers such as boxes, bags, tubes or envelopes are typically manufactured in nominal sizes, an item having dimensions that deviate from dimensions of nominally sized containers may require packing within a container having a number of voids or unused spaces, which are typically filled with dunnage. Moreover, selecting proper amounts and types of dunnage may create dilemmas for workers who are packing items within containers, as selecting excessive amounts of dunnage or overly heavy dunnage increases the weight of a container and may lead to unnecessary increases in cost, while selecting insufficient amounts of dunnage or inadequate types of dunnage may increase a risk of damage to an item during delivery. Furthermore, even when an item arrives at a destination safely, a customer or other recipient must dispose of a container in which the item arrived, along with any associated dunnage upon its arrival.

DETAILED DESCRIPTION

As is set forth in greater detail below, the present disclosure is directed to fabricating thermoformed cavities for packaging items. In some embodiments, the cavities are fabricated by passing or providing thermoplastic material such as a thermoplastic film within a vicinity of an actuator system having a plurality of individually programmable or addressable linear actuators, and causing a selected number of the linear actuators to be extended into the thermoplastic material by selected distances. Linear actuators may be coupled to electric motors, pneumatic cylinders or other systems for initiating their extension by selected distances, or causing their retraction. The number of the linear actuators, and the distances by which each of the linear actuators is to be extended, may be selected based on dimensions of the items that are to be placed into such cavities, which may be determined in any manner.

In some embodiments, the actuating systems may include systems or components for generating a differential pressure, e.g., a vacuum, across the thermoplastic material, thereby aiding in the formation of cavities within the thermoplastic material. In some other embodiments, packaging systems including one or more of the actuating systems disclosed herein may be outfitted with additional components or peripherals, including sensors for identifying items to be packaged, robotic arms or other manipulators for positioning or repositioning items within cavities formed thereby (if necessary), printers for generating shipping labels to be affixed to such cavities or packing slips to be inserted into such cavities, or cutting systems for severing a cavity from a balance of the thermoplastic material, as well as spools for decoiling or recoiling the thermoplastic material, or sealants or layers for enclosing a cavity with one or more items therein.

Figure 1A:
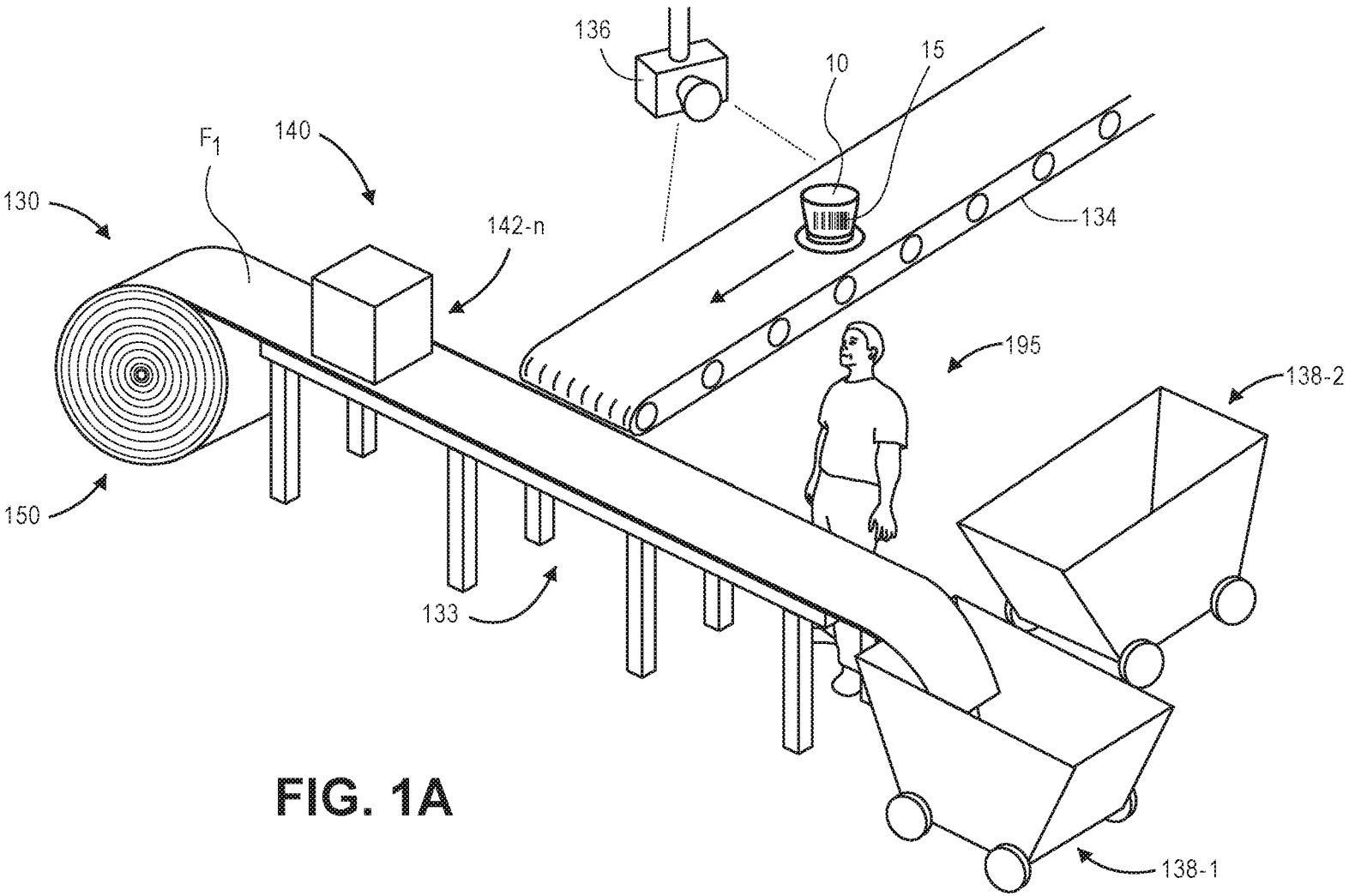
FIGS. 1A through 1J are views of aspects of one system for fabricating thermoformed cavities for packaging items in accordance with embodiments of the present disclosure.

Referring to FIGS. 1A through 1J, views of aspects of one system 100 for fabricating thermoformed cavities for packaging items in accordance with embodiments of the present disclosure are shown. As is shown in FIG. 1A, the system 100 includes a packaging system 130 having a frame 133, a conveying system 134, a sensor 136, a pair of carts 138-1, 138-2, an actuator system 140 and a decoiler spool (or drum) 150.

The conveying system 134 may be any type or form of conveyor or powered carrier for transporting items on network components (e.g., belts, chains, hooks, rails, rollers, tracks) and, as is shown in FIG. 1A, is aligned to transport items to the packaging system 130. Additionally, the sensor 136 (e.g., an imaging device such as a visual camera or a depth camera) is aligned to include at least a portion of the conveying system 134 within a field of view or operating range of the sensor 136, and configured to capture data regarding items traveling thereon, e.g., an item 10 bearing a bar code 15 or another marked identifier of the item. The carts 138-1, 138-2 may be any wheeled or stationary receptacles for receiving one or more objects therein. As is shown in FIG. 1A, each of the carts 138-1, 138-2 is positioned within a vicinity of one end of the frame 133, opposite the decoiler spool 150.

As is shown in FIG. 1A, the decoiler spool 150 is wrapped by a thermoplastic film $F_1$ and aligned upstream of the actuator system 140 to discharge the film Fi downstream therefrom, e.g., by one or more motors (not shown), in a direction of the actuator system 140. The film $F_1$ may be any thermoplastic material that is formed from any resins or other materials such as acrylics, blends, copolymers, polyamides (e.g., nylons), polycarbonates, polyesters, polyethylenes, polylactic acids, polymeric materials, polyolefins, polypropylenes, polystyrenes or thermoplastic materials, or the like, along with one or more additives, barriers, layers, pigments or other materials or substances, and may have any desired properties in tension, compression, elasticity or shear. Alternatively, the film $F_1$ may be formed from natural fibers (e.g., wood fibers, or paper) or artificial fibers that may be molded by heat and/or pressure in order to fabricate a cavity therein.

The film $F_1$ may have any desired dimensions, such as lengths, widths or thicknesses. In some embodiments, the film $F_1$ may have a thickness of approximately ten mils, or ten thousandths of one inch (0.010 in.), or less. In some other embodiments, the film $F_1$ may have a thickness of approximately ten to one hundred mils (0.010-0.100 in.). In some other embodiments, the film $F_1$ may have a thickness of greater than one hundred mils (0.100 in.), or any other thickness as may be desired. Additionally, the film $F_1$ may be any thermoplastic material, and need not take the form of a film. As is shown in FIG. 1A, the decoiler spool 150 causes the film $F_1$ to pass along the frame 133, through or beneath the actuator system 140, and toward the cart 138-1, where surplus or waste film $F_1$ is deposited. In some other embodiments, the film $F_1$ may be distributed in a sheet-like manner, e.g., manually or by an automatic feeder.

The actuator system 140 includes a plurality of actuators **142-*n* that are arranged in an array (or grid or matrix), as well as one or more motors, shafts, cylinders, power sources, pressure sources or other components for controlling the operation of the actuators 142-*n* within a common housing or structure. Each of the actuators 142-*n* is individually programmable or addressable, and may be caused to translate in either direction along a designated axis, and may thereby extend into or retracting from a film provided adjacent to tips (e.g., contact points) of the actuators 142-*n*. In a neutral (e.g., rest) position or condition, each of the actuators 142-*n* is not extended, and the respective tips of the actuators 142-*n*** are co-aligned in a common plane.

In some embodiments, the actuators **142-*n* of the actuator system 140 may be arranged in an array having a size (e.g., an area) that is not smaller than a largest cross-sectional area of any item that may be expected to travel along the conveying system 134, and for which a thermoformed cavity may be required. Likewise, the actuators 142-*n* may have dimensions (e.g., lengths) that are also selected based on a maximum height of any item that may be expected to travel along the conveying system 134, and for which a thermoformed cavity may be required. Thus, where the array of actuators 142-*n*, and the lengths of the actuators 142-*n*, are selected based on the maximum cross-sectional areas and maximum heights of the items, the actuator system 140 may be configured to generate a cavity that is sufficiently large to accommodate any of the items that may be expected to travel along the conveying system 134**, or for which a thermoformed cavity may be required, regardless of any variation in the volumes or surface features of the respective items.

Additionally, the frame 133 may be constructed in a manner that enables any of the actuators **142-*n* to be extended into the film $F_1$ by any desired distance. For example, in some embodiments, the frame 133 may consist of a pair of tracks or rails extending between the decoiler spool 150 and the cart 138-1 that are aligned in parallel, at least in vicinity of the actuator system 140, thereby providing support for at least a portion of the film $F_1$ in that area, while also permitting any of the actuators 142-*n* to be extended into the film $F_1$ in that area. A gap or space between the respective tracks or rails may form a gap or other opening that is at least as large as the array of the actuators 142-*n* of the actuator system 140, thereby enabling any of the individual actuators 142-*n* to be extended or retracted to their respective maximum extents into the film $F_1$ without coming into contact with either of the tracks or rails. In other embodiments, the frame 133 may include a substantially solid surface extending between the decoiler spool 150 and the cart 138-1 that provide support for the film $F_1$ in such areas, and an opening that is at least as large as the array of the actuators 142-*n* of the actuator system 140. With such an opening provided in an area of the actuator system 140, any of the actuators 142-*n* may be extended or retracted to their respective maximum extents into the film $F_1$ without coming into contact with the substantially solid surface. In some embodiments, the frame 133** may include a surface having the form of a lattice, a grid, or any other shape, and may be constructed from materials such as woods, plastics, metals, composite materials, or combinations thereof, or any other suitable materials.

Figure 1B:
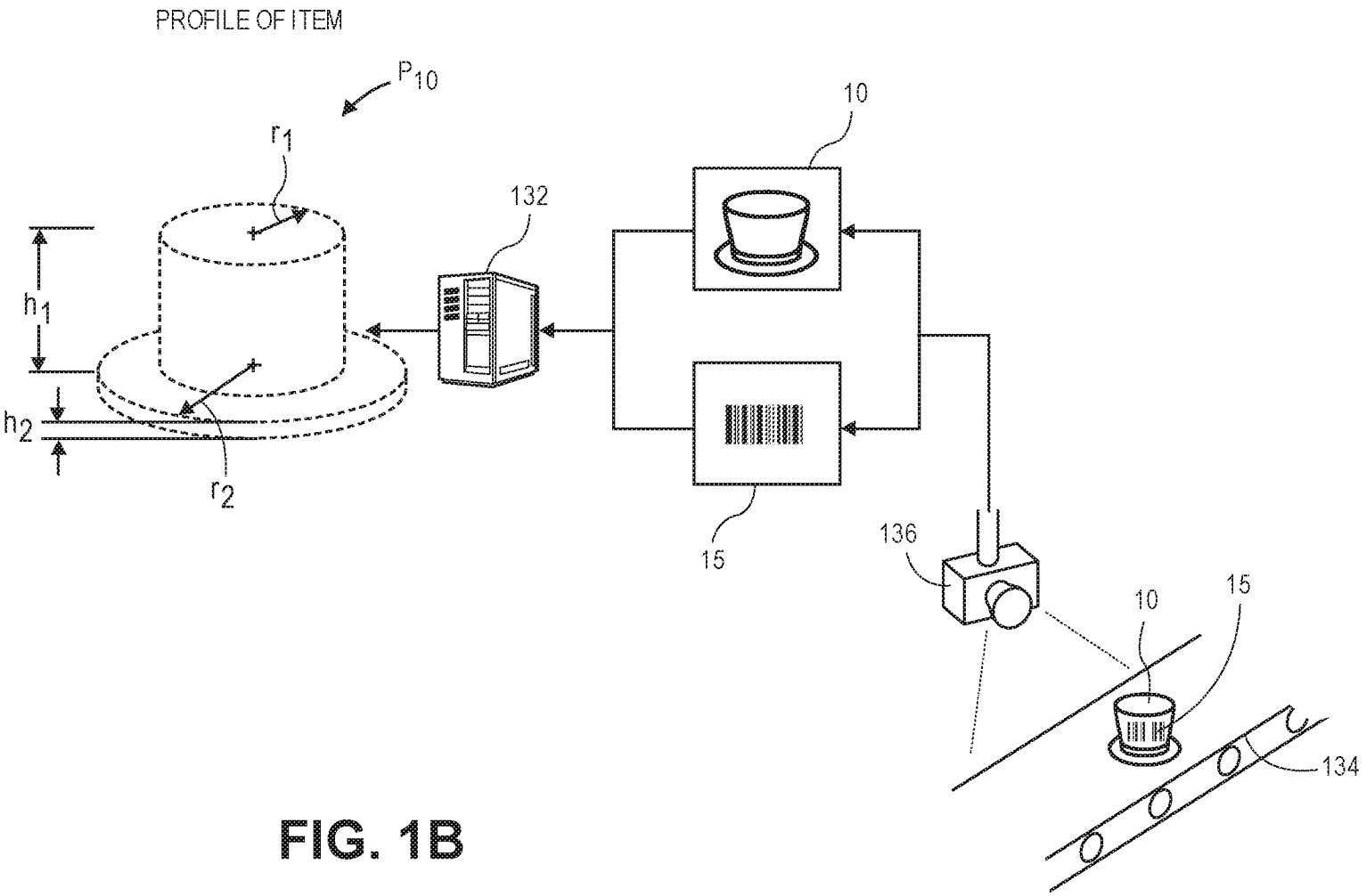

As is shown in FIG. 1B, when the item 10 passes within the field of view or operating range of the sensor 136, data is captured and processed by a server 132 or other computing device associated with the packaging system 130. For example, the sensor 136 may capture imaging data depicting the item 10 and/or the bar code 15 thereon, and process the imaging data to determine attributes of the item. In some embodiments, the server 132 may determine attributes such as dimensions, shapes or sizes of the item 10 based on the imaging data, which may include visual imaging data or depth imaging data. In some other embodiments, the server 132 may identify the item 10 based on the imaging data, e.g., by recognizing an outline or other aspect of the item 10 within the imaging data or by interpreting the bar code 15, and identify information or data regarding attributes of the item 10 maintained in one or more data stores accordingly. In still other embodiments, attributes of the item 10 may be determined based on the imaging data, and also upon identifying the item 10.

Based on the images, or information or data regarding the item 10 identified upon processing the images, a profile $P_{10}$ of the item 10 may be generated. The profile $P_{10}$ may take the form of a point cloud or other three-dimensional representation (e.g., a mesh) of the surface features of the item 10, or any other form. As is shown in FIG. 1B, where the item 10 is a hat or other cylindrical head covering having a brim, the profile $P_{10}$ may indicate one or more dimensions associated with the item 10, including heights $h_1$, $h_2$ and/or radii $r_1$, $r_2$ of aspects of the item 10. For example, as is shown in FIG. 1B, an upper portion of the item 10 defines a cylinder having a radius $r_1$ and a height $h_1$, while a lower portion of the item 10 defines a substantially shorter and wider cylinder having the radius $r_2$ and the height $h_2$.

Figure 1C:
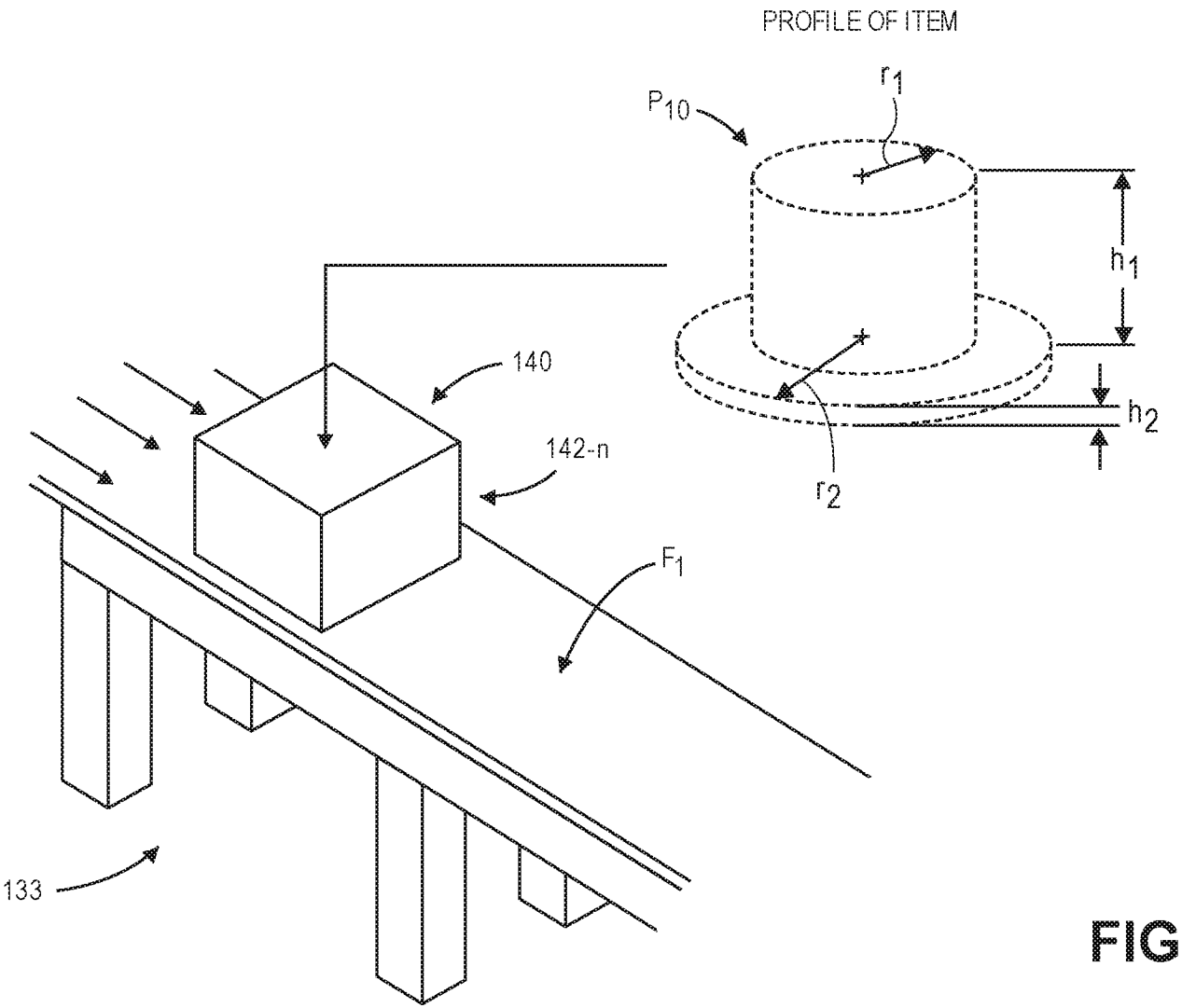

As is shown in FIG. 1C, the actuator system 140 may be programmed with information or data regarding the profile $P_{10}$ of the item 10. Based on such information or data, one or more of the actuators 142-*n* may be selected, along with distances by which each of such actuators 142-*n* are to be extended, in order to fabricate a cavity that may accommodate the item 10 within the film $F_1$.

Figure 1E:
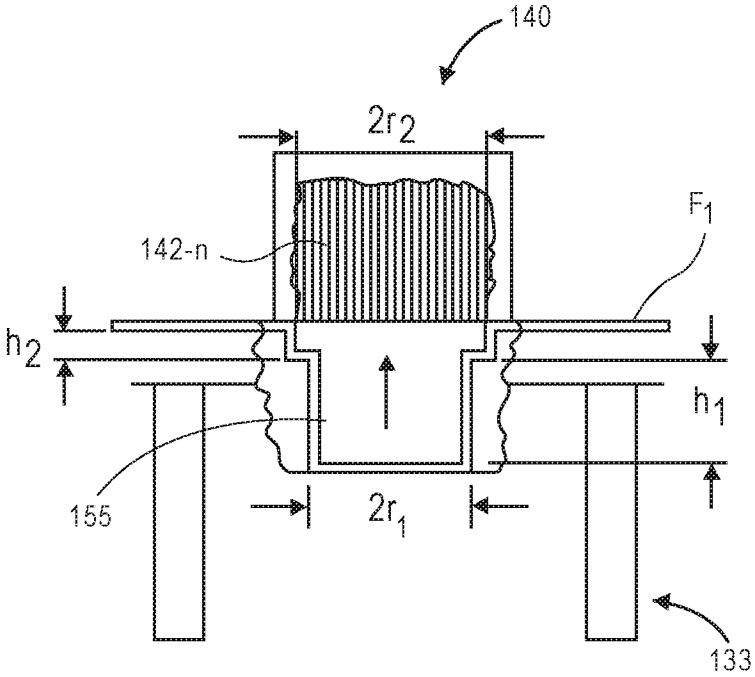
Figure 1D:
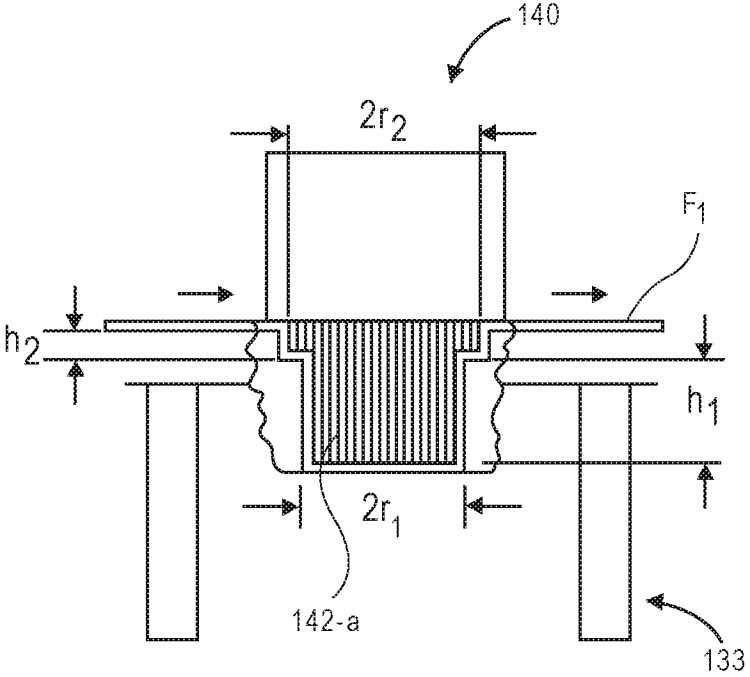

As is shown in FIG. 1D, a portion of the film $F_1$ may be passed beneath or through the actuator system 140, and a subset 142-*a* or all of the actuators 142-*n* may be extended into the portion of the film $F_1$ at selected distances. For example, as is shown in FIG. 1D, in some embodiments, the subset 142-*a* of the actuators 142-*n* may be selected based on the profile $P_{10}$ of the item 10, which includes a lower portion having a cross-sectional area defined by the radius $r_2$ and a height defined by the height $h_2$, and an upper portion having a cross-sectional area defined by the radius $r_1$ and a height defined by the height $h_1$. In such embodiments, the subset 142-*a* of the actuators 142-*n* may be identified based on the cross-sectional area defined by the radius $r_2$ of the lower portion of the item 10, viz., a product of the mathematical constant pi and a square of the radius $r_2$, and the distances by which each of the subset 142-*a* of the actuators 142-*n* are to be extended into the film $F_1$ may be selected based on the respective heights $h_1$, $h_2$.

In some embodiments, the actuator system 140 may be equipped with one or more systems for generating a differential pressure across the film $F_1$ with the subset 142-*a* of the actuators 142-*n* extended therein. For example, with the subset 142-*a* of the actuators 142-*n* extended into the film $F_1$ as is shown in FIG. 1D, a negative differential pressure (e.g., a vacuum) may be supplied from above the film $F_1$, or a positive differential pressure may be supplied from below the film $F_1$. Additionally, in some embodiments, the actuator system 140 may further include one or more blades, knives or other cutting implements (not shown) for creating one or more incisions or perforations within the film $F_1$ that may ultimately enable the cavity 155 to be severed from the balance of the film $F_1$.

As is shown in FIG. 1E, each of the actuators 142-*n* of the subset 142-*a* may be retracted from the film $F_1$ after a sufficient time, and the retraction of the actuators 142-*n* results in a cavity 155 that is sufficiently sized and shaped to accommodate the item 10 therein. In some embodiments, the subset 142-*a* of the actuators 142-*n* may be extended into the portion of the film $F_1$, such as is shown in FIG. 1D, when the portion of the film $F_1$ is at an elevated temperature, thereby enhancing the malleability of the portion of the film $F_1$. The subset of the actuators 142-*n* may remain extended into the portion of the film $F_1$ until the portion of the film $F_1$ has cooled, e.g., to or near a setting temperature of the film $F_1$, or to or near ambient temperatures in a vicinity of the packaging system 130, after which the subset of the actuators 142-*n* may be retracted from the portion of the film $F_1$, such as is shown in FIG. 1E.

Figure 1F:
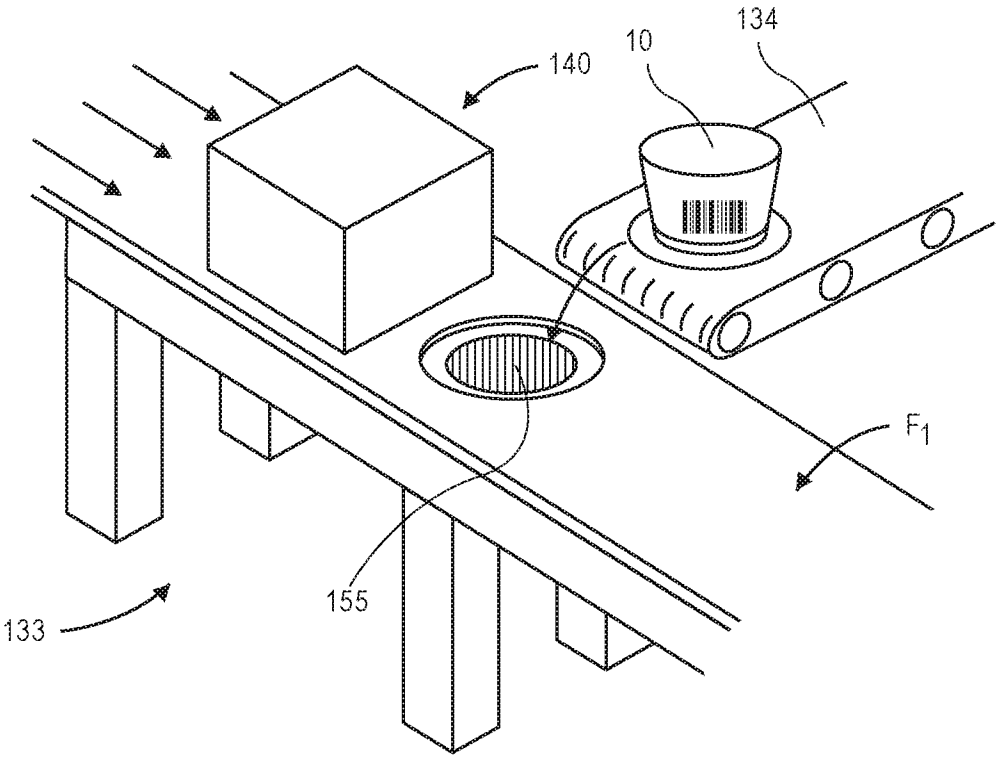
Figure 1G:
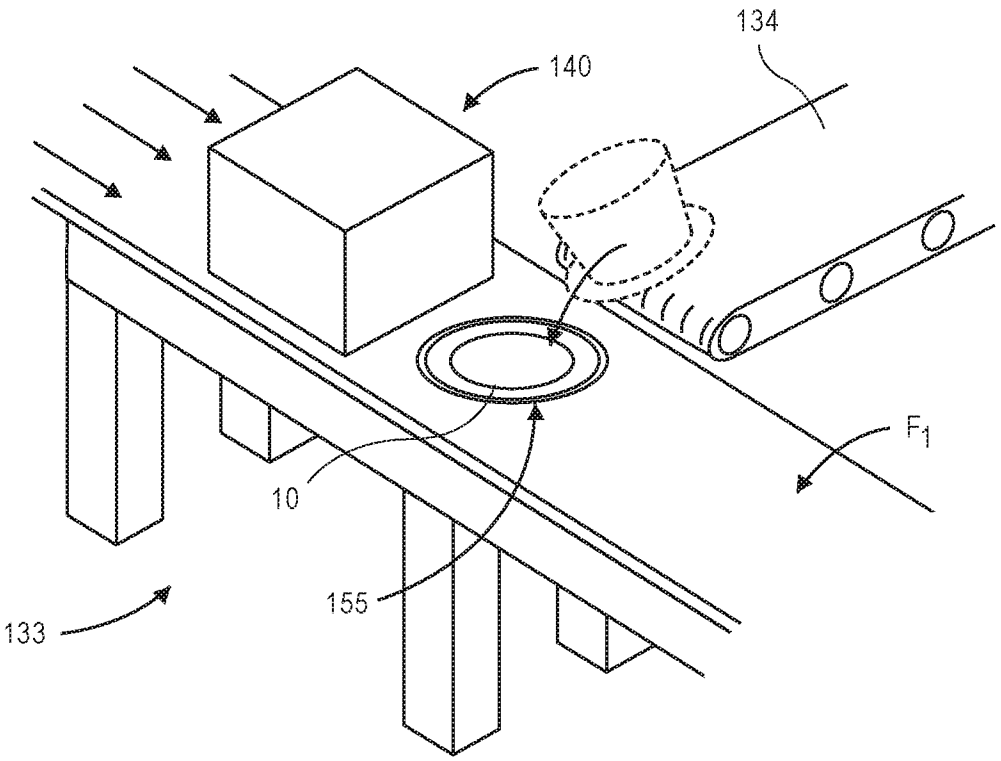

As is shown in FIGS. 1F and 1G, after the cavity 155 has been formed within the film $F_1$ the cavity 155 may be transitioned toward an end (or terminus) or other portion of the conveying system 134, from which the item 10 may be received within the cavity 155. For example, with the cavity 155 formed within a portion of the film $F_1$, the spool 150 may cause the portion of the film $F_1$ including the cavity 155 to transition from the actuator system 140 to the end of the conveying system 134 and remain in place there until the item 10 is received within the cavity 155, e.g., after the item 10 has tumbled into the cavity 155 by gravity. Alternatively, the item 10 may be transferred into the cavity 155 from the conveying system 134 by one or more diverters or diversion systems, which may push or otherwise transfer the item 10 into the cavity 155. In some embodiments, the packaging system 130 may further include one or more robotic arms or other implements (not shown) for orienting or reorienting the item 10 within the cavity 155, e.g., in the event that the item 10 does not fall from the conveying system 134 into the cavity 155 in an alignment that corresponds to the dimensions and orientation of the cavity 155, as fabricated by the subset 142-*a* of the actuators 142-*n* shown in FIGS. 1D and 1E. In some embodiments, the worker 195 or another worker (not shown) may also manually orient the item 10 within the cavity 155, as necessary.

Figure 1H:
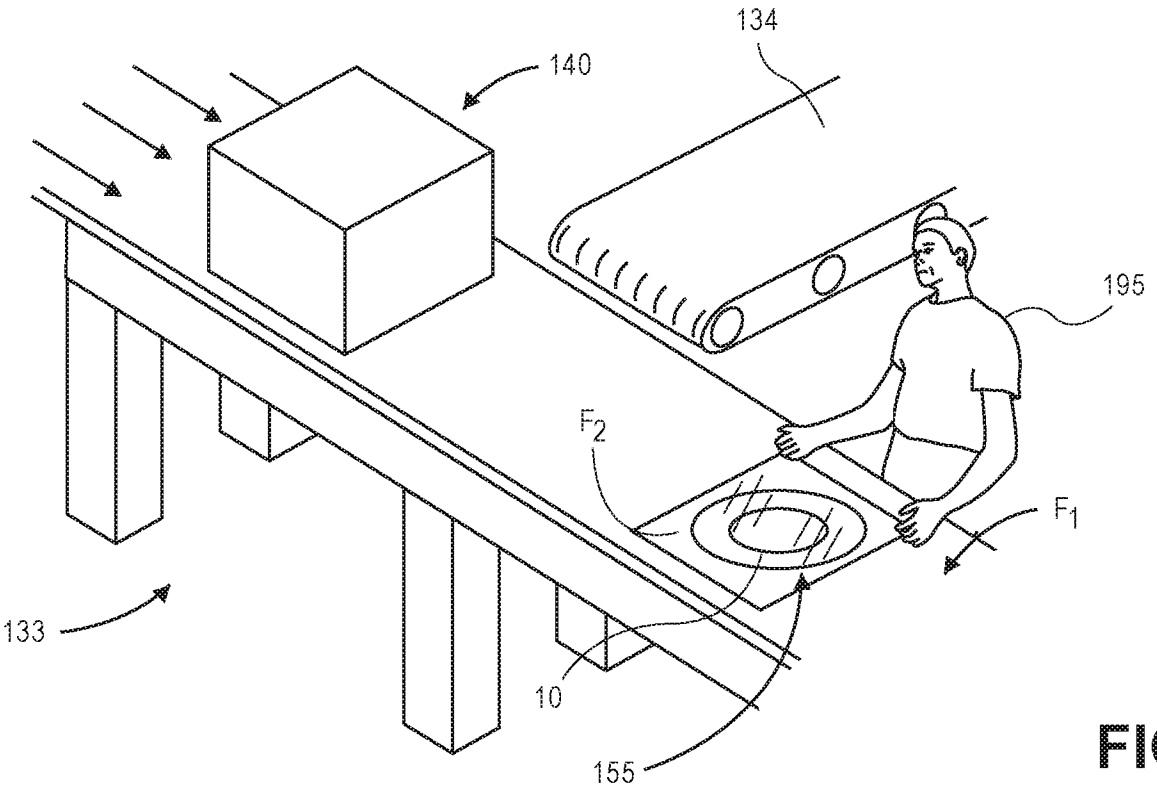

As is shown in FIG. 1H, after the item 10 is properly received into the cavity 155, the cavity 155 may be covered and sealed with the item 10 therein. For example, as is shown in FIG. 1H, the worker 195 applies a thermoplastic film $F_2$ to the portion of the film $F_1$ that includes the cavity 155, and may clamp or otherwise seal (e.g., heat-seal) the film $F_2$ in place over an opening of the cavity 155. In some other embodiments, a cavity fabricated within a thermoplastic film may be closed or sealed by a cover formed from any other materials, e.g., a sealant, a layer or another barrier, and need not be sealed using another thermoplastic film by a cover formed from other thermoplastic materials. The cavity 155 may be sealed in an airtight or watertight manner or, alternatively, enclosed in a manner that is neither airtight nor watertight.

Figure 1I:
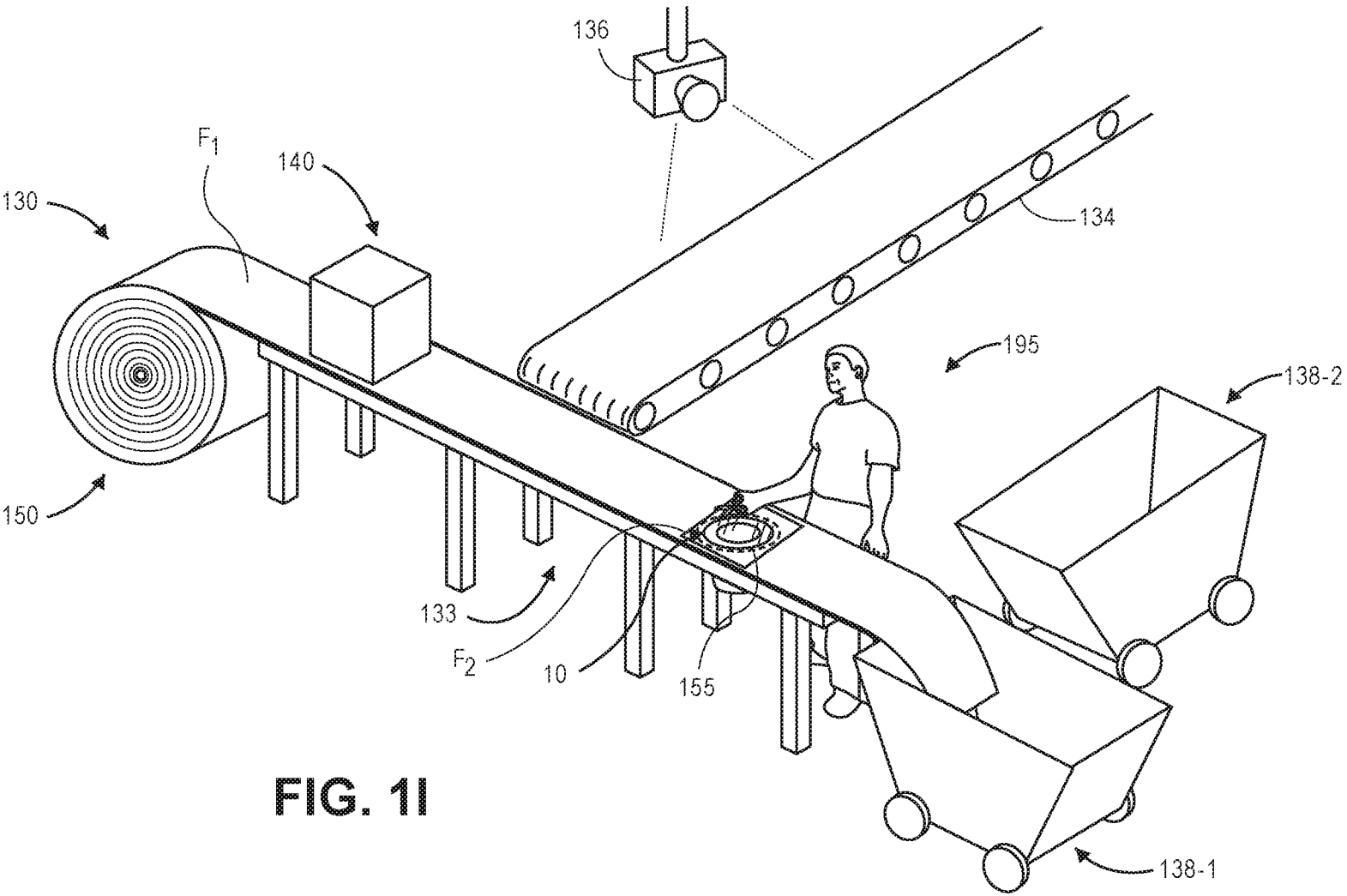
Figure 1J:
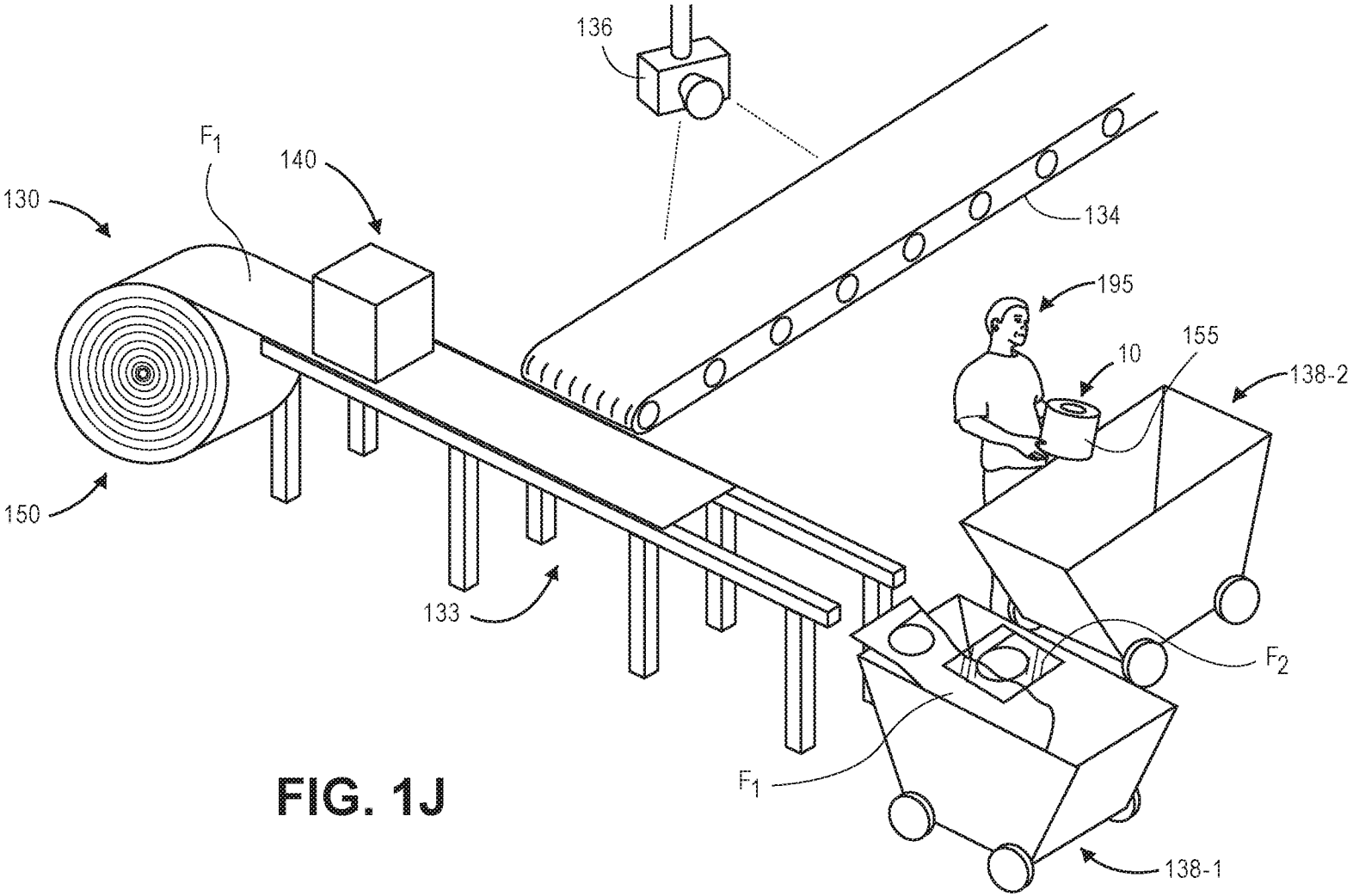

As is shown in FIG. 1I, after the item 10 is properly received into and sealed within the cavity 155, the cavity 155 may be severed from the balance of the film $F_1$ and the film $F_2$, which may be discarded into the cart 138-1. For example, as is shown in FIG. 1I, the worker 195 may cut, tear or otherwise decouple the cavity 155 from the film $F_1$, e.g., using scissors, shears, knives or the like, and manually deposit the balance of the film $F_1$ and the film $F_2$ into the cart 138-1. Alternatively, the packaging system 130 may include one or more manual or automatic systems for cutting, tearing or otherwise decoupling the cavity 155 from the film $F_1$ and the film $F_2$, and for depositing the balance of the film $F_1$ and the film $F_2$ into the cart 138-1. As is shown in FIG. 1J, after the cavity 155 has been severed from the balance of the film $F_1$ and the film $F_2$, the worker 195 may deposit the cavity 155 with the item 10 sealed therein into the cart 138-2, and the cavity 155 and the item 10 may be transported to a storage area, a distribution station or any other location for further storage or distribution. Alternatively, the cavity 155 and the item 10 may be transported to a storage area, a distribution station or any other location manually by the worker 195 or automatically by one or more machines, e.g., autonomous mobile robots, other conveying systems, or any other transportation systems.

Accordingly, the systems and methods of the present disclosure are directed to packaging items in thermoformed cavities that are fabricated in a customized manner. The cavities may be formed by linearly extending one or more actuators into a thermoplastic material, e.g., a thermoplastic film, and removing the actuators therefrom. The actuators (e.g., linear actuators) and the distances (or depth) by which such actuators are extended into the thermoplastic material may be selected based on dimensions of a specific item, in order to custom-fabricate a cavity for packaging the specific item. For example, in some embodiments, the number of the actuators in the array may be selected based on two dimensions of an item, e.g., a length and a width. The distances by which the actuators are extended into the thermoplastic material may be selected based on a third dimension of the item, e.g., one or more heights of the item, such that extending the selected actuators by the selected distances creates a cavity within the thermoplastic material that corresponds to the dimensions of the item.

The actuators may be individually programmable or addressable extensions that are disposed in a frame or housing and arranged in an array. Each of the actuators may be in communication with one or more computer devices or systems and configured to operate in response to one or more control signals. In some embodiments, thermoplastic material may be passed within a vicinity of tips of an array of actuators, each of which may be individually programmed to be extended into the thermoplastic material by a selected distance (or depth). The tips may have substantially flat contact points or faces or, alternatively, tips in the shapes of pyramids, cones, hemispheres, or any other shapes that may be selected in order to cause a desired surface to be formed in the resulting cavity. Additionally, the actuators may have cross-sections of any shape (e.g., round, square, triangular), length or size, and may be coupled to one or more shafts, motors, pneumatic cylinders, or any other components for causing the actuators to extend or retract.

Moreover, the thermoplastic materials of the present disclosure may also be formed from or include one or more resins or any materials, and may have any desired properties, in accordance with the present disclosure. For example, in some embodiments, the thermoplastic materials may be formed from one or more acrylics, blends, copolymers, polyamides (e.g., nylons), polycarbonates, polyesters, polyethylenes, polylactic acids, polymeric materials, polyolefins, polypropylenes, polystyrenes or thermoplastic materials, e.g., natural or artificial fibers that may be molded by heat and/or pressure, along with one or more additives, barriers, layers, pigments or other materials or substances, and may have any desired properties in tension, compression, elasticity or shear. In some embodiments, the thermoplastic material may be heated to a selected temperature prior to extending the one or more actuators therein, and cooled to a desired temperature (e.g., a setting temperature for a specific thermoplastic material, or an ambient temperature) prior to removing the actuators therefrom.

The dimensions of the items that are to be packaged within thermoformed cavities in accordance with the present disclosure may be determined in any manner. For example, in some embodiments, an actuator system may be specifically programmed with the dimensions of a single item, and the individual actuators that are to be extended into the film, and the distances by which each of such actuators are to be extended, may be determined for that single item on that basis. Additionally, in some embodiments, an item may be evaluated using one or more sensors, e.g., imaging devices (such as visual cameras or depth cameras), acoustic sensors, scales or other weight sensors, scanners, readers (such as radiofrequency identification readers, or RFID readers), or other sensors. Information or data captured by one or more of such sensors may be used to determine one or more dimensions of the item, or any other information regarding the item (e.g., handling restrictions, components, intended uses or destinations), e.g., based on an analysis of the information or data, or by identifying the item from the information or data. Upon identifying the item, one or more dimensions of the item in records or files maintained in one or more data stores may be identified and used to program an actuator system accordingly. Dimensions of an item may be identified, determined or obtained in any manner, and provided to an actuator system, e.g., by wired or wireless means, in order to program or control one or more actuators of the actuator system to fabricate a cavity in thermoplastic materials, e.g., by extending any number of actuators by any distance and in any manner accordingly.

The actuator systems may be configured to fabricate cavities of any size or shape in accordance with the present disclosure. For example, in some embodiments, the actuators of an array may be selected, and the distances by which the actuators are to be extended may also be selected, in order to fabricate a cavity having internal dimensions that closely conform to external dimensions of a selected item. In some embodiments, the actuators and distances may also be selected to fabricate a cavity having external dimensions that enable the cavity to be readily inserted into another container (e.g., a box), and including one or more external features or dimensions that correspond to internal features or dimensions of the other container.

Additionally, in some embodiments, the actuator systems may be configured to fabricate cavities having one or more buffer zones corresponding to aspects of selected items that are to be packaged therein. For example, actuators may be selected and programmed to be extended into thermoplastic films to fabricate a cavity having a volume that may not only accommodate an item therein but also provide one or more barriers or protective zones about the item within the cavity. Such barriers or zones may be designed to maintain an item within a specified alignment within the cavity, while also providing flexible resistance to impacts or contact for the item, e.g., by acting as dunnage or cushioning. The sizes, shapes, locations or orientations of such barriers or protective zones within the cavity may be selected on any basis, including but not limited to one or more intrinsic properties of the item, such as dimensions, sizes, preferred orientations (e.g., "this end up" restrictions), locations of anticipated contact or impact, protection requirements, or handling instructions or restrictions, including temperatures, pressures, humidities or the like.

In some embodiments, a packaging system may further include one or more robotic arms, diverters or other implements for orienting or reorienting an item within a cavity fabricated from thermoplastic film. For example, upon recognizing an eccentrically or irregularly shaped item, or an item having eccentric or irregular cross-sections (e.g., non-spherical or non-cubic), a cavity may be selected to align the item in a specific orientation within the cavity. After the cavity has been formed, e.g., by extending a selected plurality of actuators into a thermoplastic film by selected distances and retracting the actuators therefrom, the item may be manually or automatically deposited into the cavity. For example, the item may be delivered by one or more conveying systems to a location of the cavity and permitted to be deposited into the cavity, e.g., by gravity. Alternatively, the item may be deposited into the cavity in a selected orientation by a robotic arm or other system. Furthermore, to the extent that an item is not aligned in a specific orientation within a cavity, however, a human, a robotic arm, or another implement may cause the item to be reoriented within the cavity prior to enclosing the item therein, e.g., by one or more sealants, layers or barriers.

The sealants, layers or barriers that may be applied to a cavity in order to enclose an item therein may be formed from any desired materials. For example, in some embodiments, a cavity formed from a first thermoplastic film may be closed by a second thermoplastic film that may be applied thereon and clamped or otherwise sealed (e.g., heat-sealed) in place over an opening of the cavity. In some other embodiments, a cavity formed from a thermoplastic film may be closed by a snap-fit cover formed from any materials, including but not limited to another thermoplastic film. In such embodiments, the cavity may be formed by an actuator system that is programmed to form lips, edges or other features about the cavity, thereby enabling the cavity to accommodate one or more covers thereon. Any other type or form of system, formed from any type of materials, may be applied to a cavity fabricated from thermoplastic film in accordance with the present disclosure. Moreover, such cavities may be sealed in an airtight or watertight manner or, alternatively, enclosed in a manner that is neither airtight nor watertight.

The packaging systems of the present disclosure may further include one or more printers or other printing systems for generating records in hard copy format for insertion into a cavity, along with one or more items, and prior to sealing or otherwise enclosing the cavity. Alternatively, or additionally, one or more embodiments of the packaging systems may be configured to insert one or more chips, trackers or other systems for automatically reporting a position of a cavity or an item therein according to one or more wireless protocols or standards, e.g., Bluetooth®, Wireless Fidelity (or "Wi-Fi"), RFID, or any other protocol or standard.

Figure 2:
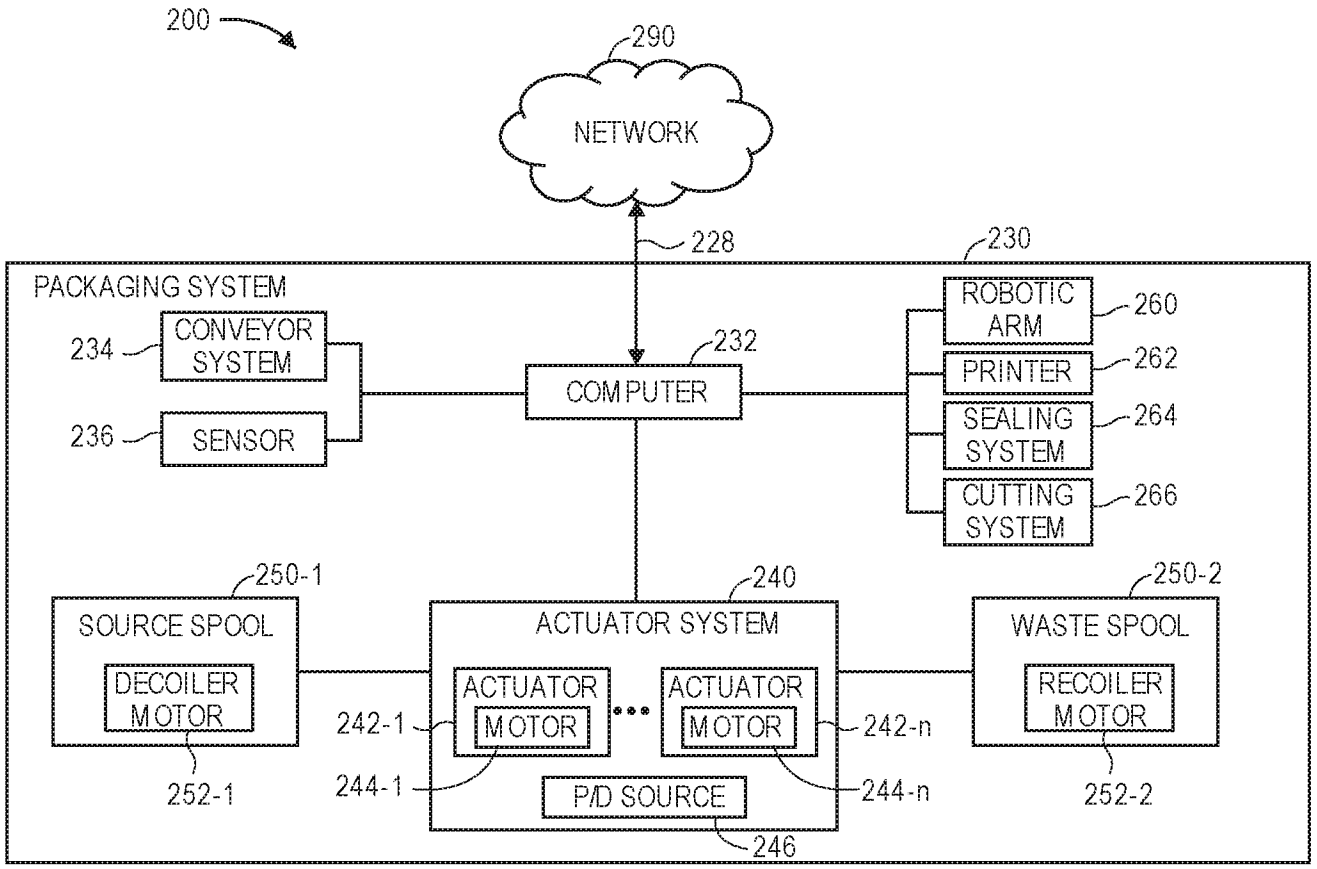
FIG. 2 is a block diagram of one system for fabricating thermoformed cavities for packaging items in accordance with embodiments of the present disclosure.

Referring to FIG. 2, a block diagram of one system for fabricating thermoformed cavities for packaging items in accordance with embodiments of the present disclosure is shown. Except where otherwise noted, reference numerals preceded by the number "2" in FIG. 2 refer to elements that are similar to elements having reference numerals preceded by the number "1" shown in FIGS. 1A through 1J.

As is shown in FIG. 2, the packaging system 230 includes a computer system (e.g., a computer device or server) 232, a conveyor system 234, a sensor 236, an actuator system 240, a source spool 250-1 and a waste spool 250-2. The packaging system 230 further includes a robotic arm 260, a printer 262, a sealing system 264 and a cutting system 266.

The packaging system 230 may be any facility that is configured to fabricate one or more cavities from thermoplastic material, with the cavities being customized based on one or more dimensions or other attributes of items to be inserted to such cavities. For example, the packaging system 230 may be associated with any entity or individual that intends to package one or more items into cavities fabricated from thermoplastic materials, such as a fulfillment center, a warehouse or a like facility that is adapted to receive, store, process and/or distribute items and may include one or more receiving stations, storage areas, distribution stations or the like. Alternatively, the packaging system 230 may be provided in association with any other facility, e.g., a postal facility, a shipping facility, a retail establishment or any other materials handling facility for receiving, storing, processing and/or distributing items.

The computer 232 may be one or more servers, computer devices or machines having one or more processors, memory components (e.g., databases and/or data stores) and transceivers (e.g., transmitters and receivers), as well as any number of input/output devices (not shown), such as keyboards, keypads, mice, styluses, touchscreens, RFID readers, or other devices that are configured to operate one or more order processing and/or communication systems and/or software applications having one or more user interfaces, or to communicate with one or more other computing devices or machines. For example, the computer 232 may be configured to receive information or data from, or provide information or data to, one or more of the conveyor system 234, the sensor 236, the actuator system 240, the source spool 250-1, the waste spool 250-2, the robotic arm 260, the printer 262, the sealing system 264 and/or the cutting system 266, e.g., by wired or wireless connections. The computer 232 may also be configured to interpret information or data regarding one or more items that is captured by the sensor 236, e.g., to determine one or more attributes of such items, or to identify such items, and to provide one or more instructions for operating one or more of the conveyor system 234, the actuator system 240, the source spool 250-1, the waste spool 250-2, the robotic arm 260, the printer 262, the sealing system 264 and/or the cutting system 266 based on such information or data.

The computer 232 may be further connected to any number of other servers, computer devices or machines over a network 290, e.g., by the sending and receiving of digital data. For example, the computer 232 may be configured to transmit information or data to, or receive information or data from, one or more servers, computer devices or machines associated with a marketplace, a fulfillment center, a customer or a source of items, such as a manufacturer, a merchant, a seller, a vendor, or any other entity. The computer 232 may transmit instructions, or receive or transmit any other information or data, directly or over the network 290 by any known wired or wireless means, through the sending and receiving of digital data. The protocols and components for providing communication between the computer 232 and such devices or systems are well known to those skilled in the art of computer communications and need not be described in more detail herein.

The conveying system 234 may be configured to transport one or more items to or from the packaging system 230, such as from a receiving station or a storage area of a fulfillment center, or to a storage area or a destination station of a fulfillment center. For example, the conveying system 234 may include any number of mover systems, diversion systems or control systems for transporting items from one or more origins to one or more destinations within the packaging system 230. In some embodiments, the conveying system 234 may include one or more belted conveyor systems, static rail or moving rail systems, rack-and-pinion systems or the like, and such systems may be configured to transport one or more items by way of stationary carriers and moving conveyors, or moving carriers and stationary conveyors, or a combination of stationary and moving carriers or stationary and moving conveyors. The conveying system 234 may also include any necessary extensions and/or termini that may be associated with one or more receiving stations, storage areas, distribution stations or the packaging station at one or more locations. Additionally, the conveying system 234 may further include one or more diversion systems for transferring items between or among carriers or conveyors, and such diversion systems may include, but are not limited to, pusher diverters, steered wheel diverters or any other type of diverters or diversion systems for transferring objects from one system to another, and at any elevation or depth. Any type of carriers, conveyors, diverters or other components may be utilized to transfer objects from one location associated with the packaging system 230 to another location associated with the packaging system 230 in accordance with the present disclosure.

The sensor 236 may be any form of sensing device for capturing information or data regarding conditions in or around the packaging system 230, and may be operatively or functionally joined with the computer 232 or one or more other components by any wired or wireless means. For example, the sensor 236 may be configured to read or interpret one or more external markings on an object, as well as to determine a distance from between the sensor 236 and the object. Some such external markings may include images, bar codes, QR codes, bokodes, characters, numbers, symbols, or colors that are located within a specific distance or depth of field of the sensor 236. Any number or type of sensors 236 that may be provided in association with the packaging system 230 in accordance with the present disclosure, including but not limited to cameras or other optical sensors, temperature sensors, heat sensors, radiation sensors or position and/or orientation sensors, is not limited.

Those of ordinary skill in the pertinent art will also recognize that the sensor 236 may also be or include a camera or other imaging device configured to capture one or more images of items within its field of view or operating range, defined as a function of a distance between a sensor and a lens, viz., a focal length, including but not limited to digital cameras (e.g., an RGB color camera, a still camera, a motion capture/video camera or any other type or form of camera for capturing color, grayscale and/or black-and-white images), depth sensors, range cameras, thermal imaging cameras (e.g., infrared cameras), radiographic cameras, ultraviolet cameras, radar sensors or laser sensors, and any associated memory or storage components and processors, as well as one or more photosensitive surfaces, filters, chips, electrodes, clocks, boards, timers or any other relevant features (not shown). Where the sensor 236 is configured to capture imaging data, the imaging data may be stored in any variety of formats including, but not limited to, YUYV, RGB, RAW, .BMP, .JPEG, .GIF, or the like.

In some embodiments, the sensor 236 may be hard-mounted to or embedded within one or more surfaces of the packaging system 230 in a manner that maintains the sensors in a fixed configuration or angle with respect to one, two or three axes. Alternatively, however, the sensor 236 may be provided with one or more motors and/or controllers for manually or automatically operating one or more of the components, or for reorienting an axis or direction, i.e., by panning or tilting the sensor 236.

Information and/or data regarding features or objects expressed in a digital image captured using the sensor 236 may be extracted from the image in any number of ways. For example, a color of a pixel, or a group of pixels in a digital image may be determined and quantified according to one or more standards, e.g., the RGB ("red-green-blue") color model, in which the portions of red, green or blue in a pixel are expressed in three corresponding numbers ranging from 0 to 255 in value, or a hexadecimal model, in which a color of a pixel is expressed in a six-character code, wherein each of the characters may have a range of sixteen. Moreover, a texture of a feature or object expressed in a digital image captured using the sensor 236 may be identified using one or more computer-based methods, such as by identifying changes in intensities within regions or sectors of the image, or by defining areas of an image corresponding to specific surfaces. Furthermore, edges, contours or outlines of objects may be identified in a digital image using one or more algorithms or machine-learning tools. For example, some such algorithms or tools may recognize edges, contours or outlines of objects in the digital image, or of portions of objects, and may match the edges, contours or outlines of the objects against a database containing information regarding edges, contours or outlines of known objects.

The actuator system 240 may be any system configured to cause one or more individually programmable or addressable actuators 242-1 . . . **242-*n* to translate in either direction along a designated axis, thereby extending a selected number of the actuators 242-1 . . . 242-*n* by selected distances into a thermoplastic material (e.g., a thermoplastic film) provided adjacent to tips of the actuators 242-1 . . . 242-*n*, or retracting the selected number of the actuators 242-1 . . . 242-*n* from the material accordingly. The actuators 242-1 . . . 242-*n* may be extensions that are coupled, e.g., by a shaft or other like extension, to individually programmable or addressable motors 244-1 . . . 244-*n* that are disposed in a frame or housing and arranged in an array. Each of the actuators 242-1 . . . 242-*n* and/or the motors 244-1 . . . 244-*n* may be in communication with one or more computer devices or systems, e.g., the computer 232, and may operate in response to one or more control signals. Alternatively, the actuator system 240 may include one or more computer devices or systems for controlling the operation of the one or more actuators 242-1 . . . 242-*n*** in response to one or more control signals.

In some embodiments, the motors 244-1 . . . **244-*n*** may be linear induction motors, or "linear motors," e.g., induction motors that are used to cause motion in a straight line, as opposed to rotation, i.e., torque. Linear induction motors operate under the same principles as induction motors in general, but feature a stator that is unrolled into a flat plate, rather than a coiled, rounded stator. Thus, linear induction motors typically feature stator windings, viz., primary windings, of a finite length, rather than a continuous loop.

In some other embodiments, the motors 244-1 . . . **244-*n* may be servo motors or any other type or form of motors that are configured to extend or retract a respective one of the actuators 242-1 . . . 242-*n* by selected distances. In still other embodiments, and in lieu of or along with one or more of the motors 244-1 . . . 244-*n*, a pneumatic device or cylinder that is caused to extend or retract a respective one of the actuators 242-1 . . . 242-*n* by fluid pressure. Any type or form of motor or other prime mover may be associated with one or more of the actuators 242-1 . . . 242-*n* and used to extend or retract a respective one of the actuators 242-1 . . . 242-*n*** by a selected distance in accordance with the present disclosure.

The pressure differential source 246 may be any system or component for generating a pressure differential across thermoplastic material (e.g., a thermoplastic film) prior to or after extending one or more of the actuators 242-1 . . . **242-*n* therein, thereby enhancing the contact between the thermoplastic material and contact points of the actuators 242-1 . . . 242-*n* extended therein. For example, the pressure differential source 246 may be configured to generate a negative pressure differential (e.g., a vacuum and/or suction) on a same side of the thermoplastic material as the actuators 242-1 . . . 242-*n*, thereby drawing the thermoplastic material further into contact with the contact points of the respective actuators 242-1 . . . 242-*n* when the one or more of the actuators 242-1 . . . 242-*n* is extended therein. Alternatively, the pressure differential source 246 may be configured to generate a positive pressure differential on an opposite side of the thermoplastic material from the actuators 242-1 . . . 242-*n*, thereby pushing the thermoplastic film further into contact with the contact points of the respective actuators 242-1 . . . 242-*n* when the one or more of the actuators 242-1 . . . 242-*n* is extended therein. In some embodiments, the pressure differential source may include one or more pumps (e.g., a vacuum pump), ejectors, blowers, valves, filters, power supplies or regulators, or any other components, as desired. Furthermore, in some embodiments, the pressure differential source 246 may be provided within a common housing of the actuator system 240 that also includes the actuators 242-1 . . . 242-*n* and/or the motors 244-1 . . . 244-*n*. In some other embodiments, however, the pressure differential source 246 may be provided within a separate housing, and functionally joined to a housing that includes the actuators 242-1 . . . 242-*n* and/or the motors 244-1 . . . 244-*n*** by one or more pipes, hoses or other connections.

The spools (or drums) 250-1, 250-2 may be any rotatable systems that may be operated to discharge thermoplastic material (e.g., thermoplastic film) therefrom, or to receive thermoplastic material thereon. The spools 250-1, 250-2 may have hubs or flanges of any diameter or width, and may be utilized to load any amount of thermoplastic material thereon or to discharge any amount of thermoplastic material therefrom, at any rates. As is shown in FIG. 2, the spools 250-1, 250-2 include a source spool (e.g., a feed spool) 250-1 and a waste spool (e.g., a take-up spool) 250-2, each of which may be configured to retract or extend thermoplastic material automatically, e.g., by one or more motors 252-1, 252-2 or, alternatively, by one or more manual operators (e.g., hand cranks). For example, as is shown in FIG. 2, the source spool 250-1 is associated with a decoiler motor 252-1 and configured to discharge thermoplastic material toward the actuator system 240, while the waste spool 250-2 is associated with a recoiler motor 252-2 and configured to receive waste or scrap thermoplastic material thereon, after one or more cavities have been fabricated from the thermoplastic material. The decoiler motor 252-1 and the recoiler motor 252-2 may be any type or form of motor for causing a rotation of one of the spools 250-1, 250-2 about a predetermined axis, including but not limited to a servo motor or an induction motor, or any other type or form of motor.

Alternatively, in some embodiments, the packaging system 230 need not include either or both of the spools 250-1, 250-2 and/or the motors 252-1, 252-2. For example, the packaging system 230 may instead include one or more systems for providing thermoplastic material to the actuator system 240 in sheets or in any other manner, either manually or automatically.

The robotic arm 260 may be any system having an end effector configured to grasp, orient, reorient and/or release an item, e.g., an item that is to be inserted into a cavity fabricated from thermoplastic material by the actuator system 240, or an item that has been inserted into such a cavity. For example, when a cavity has been fabricated from thermoplastic material, and an item has been deposited into the cavity in an orientation or alignment that is not an optimal or intended orientation or alignment, the robotic arm 260 may be used to reorient the item within the cavity. Alternatively, the robotic arm 260 may be used to engage an item and deposit the item into a cavity, or, alternatively, to sever a cavity from thermoplastic material or deposit the cavity in a desired location, e.g., the cart 138-2 of FIG. 1H. Alternatively, or in addition to the robotic arm 260, one or more workers or other machines (e.g., diverters) may be used to properly orient an item within a cavity in accordance with the present disclosure.

The printer 262 may be any form of analog or digital printer, e.g., a toner-based, inkjet, solid ink, inkless, dot-matrix or daisy wheel printer, configured to impose one or more characters, symbols or other markings onto a paper-type product that may be inserted into a cavity along with one or more items, or applied or affixed to a surface of the cavity prior to or after one or more items have been inserted therein. The printer 262 may be configured to operate separately or in conjunction with the actuator system 240 and/or either or both of the spools 250-1, 250-2, and may include various material supply facilities such as rolls, trays or carriages which may provide blank stock to the printer 262 for printing. The printer 262 may be further connected to or otherwise associated with one or more computer devices, such as a direct or networked connection with the computer 232 or a networked connection with any other computer device outside of the packaging system 230, and may receive one or more commands to print instructions or data onto a predetermined sheet of a selected type or form, such as a packing slip, a gift card, a receipt, a shipping label, a sorting label, or any other type or form of sheet. Moreover, the printer 262 may be used to print documents for various applications. For example, a printer 262 may be configured to print packing slips or return labels for inclusion in one or more containers that are being prepared for delivery to one or more customers or destinations, or to print shipping or sorting labels that are to be applied or affixed to such containers prior to delivery. Additionally, the printer 262 may further include one or more components for transferring a printed document into a cavity fabricated from thermoplastic material or for performing any other function.

The sealing system 264 may be any system for closing or sealing a cavity formed in thermoplastic material by the actuator system 240. In some embodiments, the sealing system 264 may close or seal a cavity with one or more items therein using one or more closing agents such as adhesive tapes or other layers, bands, belts, straps, loops or other apparatuses, shrink-wrap plastic layers, as well as one or more glues, cements or other sealing substances. In some embodiments, the sealing system 264 may be an impulse heat sealer having one or more sealing bars for closing around one or more heated conductors in contact with one or more layers of thermoplastic material. For example, cavities may be closed with shipping tape or packing tape (e.g., strongly adhesive plastic tape that may be reinforced with one or more fiberglass or woven threads), as well as duct tape (e.g., a composite of woven fabric and polyethylene that is backed with a high-tack adhesive and may form waterproof or nearly waterproof seals), electrical tape (e.g., an elastic polyvinylchloride strip backed with a rubber-like adhesive), masking tape or painter's tape (e.g., a thin and easily torn strip of paper having a releasable pressure-sensitive adhesive backed thereon), or any other like forms of tape or other flexible adhesives. In addition to tapes, such cavities may be sealed with any type or form of glues or cements, e.g., liquid adhesives comprising acetates, aliphatic compounds, epoxies or polyurethanes, or any other type or form of sealants. In accordance with the present disclosure, items may be sealed or enclosed within cavities or, alternatively, cavities having items therein may be sealed or enclosed within one or more other containers, e.g., boxes, canisters, crates, envelopes or tubes, which may be formed from any suitable material (e.g., corrugated cardboard, wood, paper, metal, plastic) and may have any standard or custom sizes. Alternatively, any technique for closing or sealing a cavity fabricated from one or more layers of thermoplastic material may be utilized by the sealing system 264.

The cutting system 266 may be any device or machine having one or more blades or other cutting implements that are configured to cut, pierce, slice, slit or split thermoplastic material, thereby enabling a cavity fabricated therefrom to be severed from waste or scrap portions of the thermoplastic material. The cutting system 266 may require manual operation for cutting thermoplastic material, e.g., a pair of scissors, a guillotine-style paper cutter, a rolling-style paper cutter, or may include one or more motors or machines for automatically cutting the thermoplastic material. Any type or form of device that may make one or more straight or curvilinear cuts in thermoplastic material may be utilized in accordance with the present disclosure.

The computer 232 may further generate instructions for controlling operations of the conveying system 234, the sensors 236, the actuator system 240, the source spool 250-1, the waste spool 250-2, the robotic arm 260, the printer 262, the sealing system 264 and/or the cutting system 266, or any other aspects of the packaging system 230, e.g., or one or more receiving stations, storage areas or distribution stations.

The network 290 may be any wired network, wireless network, or combination thereof, and may comprise the Internet in whole or in part. In addition, the network 290 may be a personal area network, local area network, wide area network, cable network, satellite network, cellular telephone network, or combination thereof. The network 290 may also be a publicly accessible network of linked networks, possibly operated by various distinct parties, such as the Internet. In some embodiments, the network 290 may be a private or semi-private network, such as a corporate or university intranet. The network 290 may include one or more wireless networks, such as a Global System for Mobile Communications (GSM) network, a Code Division Multiple Access (CDMA) network, a Long-Term Evolution (LTE) network, or some other type of wireless network. Protocols and components for communicating via the Internet or any of the other aforementioned types of communication networks are well known to those skilled in the art of computer communications and thus, need not be described in more detail herein.

Some embodiments of the systems and methods of the present disclosure may also be provided as a computer executable program product including a transitory or non-transitory machine-readable storage medium having stored thereon instructions (in compressed or uncompressed form) that may be used to program a computer (or other electronic device) to perform processes or methods described herein. The machine-readable storage medium may include, but is not limited to, hard drives, floppy diskettes, optical disks, CD-ROMs, DVDs, ROMs, RAMs, erasable programmable ROMs ("EPROM"), electrically erasable programmable ROMs ("EEPROM"), flash memory, magnetic or optical cards, solid-state memory devices, or other types of media/machine-readable medium that may be suitable for storing electronic instructions. Further, embodiments may also be provided as a computer executable program product that includes a transitory machine-readable signal (in compressed or uncompressed form). Examples of machine-readable signals, whether modulated using a carrier or not, may include, but are not limited to, signals that a computer system or machine hosting or running a computer program can be configured to access, or including signals that may be downloaded through the Internet or other networks.

Figure 3:
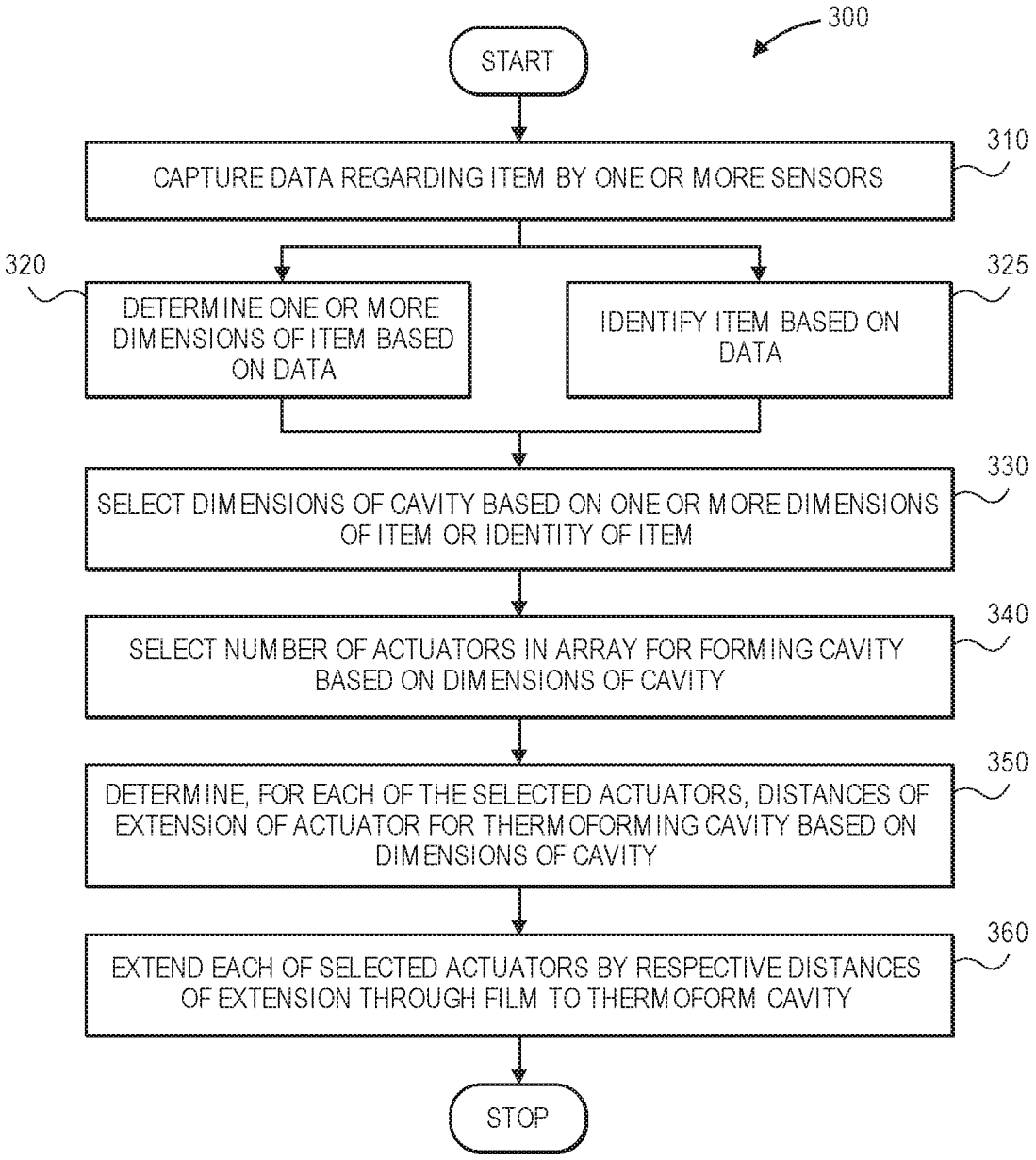
FIG. 3 is a flow chart of one process for fabricating thermoformed cavities for packaging items in accordance with embodiments of the present disclosure.

Referring to FIG. 3, a flow chart 300 of one process for fabricating thermoformed cavities for packaging items in accordance with embodiments of the present disclosure is shown. At box 310, data regarding an item is captured using one or more sensors. For example, the sensors may include one or more imaging devices (e.g., visual imaging devices configured to capture color, grayscale or black-and-white visual imaging data, or depth imaging devices configured to capture depth or ranging data), acoustic sensors, scales or other weight sensors, scanners, readers (such as RFID readers), Bluetooth® receivers, or other sensors. The data may include one or more digital images, sound files, values of masses or weights, RFID signals, Bluetooth® signals or other information or data. In some embodiments, the data may be captured as the item is stationary. In other embodiments, the data may be captured as the item is in motion, e.g., on one or more conveyor systems, such as the conveying system 134 of FIG. 1A, or as the item is being transported by one or more humans or machines, such as autonomous mobile robots.

At box 320, one or more dimensions of the item are determined based on the captured data, and in parallel, at box 325, the item is identified based on the data. For example, where the captured data includes visual imaging data, the one or more dimensions may be calculated or estimated by processing the imaging data, e.g., to recognize one or more colors, textures, fabrics, shapes, cuts or other aspects of the item therein, and to determine or estimate the dimensions accordingly. Alternatively, or additionally, where one or more surfaces of the item include one or more marked identifiers, e.g., images, bar codes, QR codes, bokodes, characters, numbers, symbols, or colors, the visual imaging data may be processed to recognize and interpret the identifiers, and the interpreted identifiers may be used to locate the dimensions or other intrinsic or extrinsic data regarding the item in one or more records or files maintained in a data store. Where the captured data includes depth imaging data, a point cloud or other three-dimensional representation (e.g., a mesh) of the item may be generated based on the data, and used to determine or estimate the dimensions accordingly. The dimensions may also be determined or estimated based on the presence of monocular cues in visual or depth imaging data. Where the captured data includes a mass of the item, the mass may be compared against known masses of items in one or more records or files maintained in a data store, and information regarding the item, including one or more dimensions, may be identified based on the mass. Where the captured data includes one or more RFID signals or Bluetooth® signals identifying the item, information regarding the item, including the one or more dimensions, may be identified upon decoding such signals. The dimensions of the item may be determined or identified based on any type or form of data captured using one or more sensors in accordance with the present disclosure. Alternatively, the one or more dimensions may be manually or automatically programmed into one or more computer systems, e.g., by one or more input/output interfaces.

In some embodiments, the dimensions of the item may be determined based exclusively on the data captured at box 310, e.g., at box 320 alone. In some embodiments, the dimensions of the item may be determined based exclusively on the identity of the item, as determined from the data captured at box 310, e.g., at box 325 alone. In some embodiments, the dimensions of the item may be determined based on the data captured at box 310, e.g., at box 320, and also based on the identity of the item as determined at box 310, e.g., at box 325. A first set of dimensions determined based on one of the data or the identity of the item may be compared to a second set of dimensions determined based on another of the data or the identity of the item, e.g., as a confirmation or a check of the first set of dimensions.

At box 330, dimensions of a cavity for accommodating the item are selected based on the one or more dimensions of the item determined at box 320, or based on the identity of the item determined at box 325. For example, where a snug fit is desired for the item, a cavity having dimensions that closely mimic the dimensions of the item determined at box 320 or dimensions determined based on the identity of the item determined at box 325, e.g., to within a specific tolerance, may be defined. Where a looser fit is desired for the item, however, the cavity may have dimensions that more broadly correspond to the dimensions of the item. Furthermore, where packaging the item in a cavity having one or more buffer zones (e.g., barriers or other protective zones) is desired, dimensions of the cavity may be selected to provide such buffer zones at corners, vertices, surfaces or selected features (e.g., particularly sensitive components such as touchscreens, glassware or the like) of the item.

At box 340, a number of actuators provided in an array are selected to form the cavity based on the dimensions of the cavity determined at box 330. For example, where the item has a specific cross-sectional area, a number of actuators having contact points or faces, or cross-sections, with aggregate areas that equal or exceed the cross-sectional area of the item may be selected. At box 350, for each of the actuators selected at box 340, distances by which such actuators are to be extended to define a cavity having a volume for accommodating the item are determined based on the dimensions of the cavity as determined at box 330. For example, the distances may correspond to heights of the item in specific locations with respect to the number of actuators selected at box 340. In some embodiments, where an eccentric or irregular item is to be packaged in a cavity fabricated from thermoplastic material, e.g., a thermoplastic film, a specific orientation of the eccentric or irregular item may be selected, and the number of actuators and the distances by which such actuators are to be extended may be selected to fabricate a cavity for the item in the specific orientation within the thermoplastic material.

At box 360, each of the selected actuators is extended by their respective distances through thermoplastic material to fabricate a thermoformed cavity therein, and the process ends. In some embodiments, the actuators may each be coupled to one or more motors, pneumatic systems or other prime movers and independently programmed or addressed to extend into a thermoplastic film or other thermoplastic material by the distances determined at box 350, thereby forming a cavity within the thermoplastic film having a width that corresponds to cross-sectional areas of the selected actuators in the aggregate, and depths at various locations defined by the distances by which each of the selected actuators is extended. The thermoplastic materials may be formed from any resins or other materials such as acrylics, blends, copolymers, polyamides (e.g., nylons), polycarbonates, polyesters, polyethylenes, polylactic acids, polymeric materials, polyolefins, polypropylenes, polystyrenes or other thermoplastic materials, or the like, along with one or more additives, barriers, layers, pigments or other materials or substances, and may have any desired properties in tension, compression, elasticity or shear. In some embodiments, the thermoplastic material may be at an elevated temperature prior to extending the actuators into the thermoplastic material, and may be permitted to cool to a setting temperature for the thermoplastic material, or to ambient temperatures, prior to retracting the actuators from the thermoplastic material. Additionally, in some embodiments, a robotic arm, a diverter or any other component may come into contact with an item and cause the item to be deposited and/or properly aligned within the cavity. In some embodiments, a printer may generate a packing slip, a receipt or another document that may be inserted into the cavity along with one or more items, or affixed to an external surface of the cavity, prior to delivering the container to an intended destination. Moreover, the cavity may be manually or automatically severed from a balance of the thermoplastic material prior to or after inserting the item therein, e.g., by one or more cutting implements or systems.

As is discussed above, an actuator system may include a plurality of actuators arranged in an array (or grid or matrix) that may be individually programmable or addressable in order to cause one or more selected actuators to extend by selected distances. Where the array has a size that is greater than a cross-sectional area of a largest item for which a thermoformed cavity is desired, the actuator system may be programmed with data regarding dimensions of an item or one or more optional barriers or buffer zones, and the actuator system may fabricate a cavity to accommodate any item from a thermoplastic material, and the cavity may include such barriers or buffer zones, as desired. Referring to FIGS. 4A through 4D, views of aspects of systems for fabricating thermoformed cavities for packaging items in accordance with embodiments of the present disclosure are shown. Except where otherwise noted, reference numerals preceded by the number "4" in FIGS. 4A through 4D refer to elements that are similar to elements having reference numerals preceded by the number "2" in FIG. 2 or by the number "1" shown in FIGS. 1A through 1J.

Figure 4A:
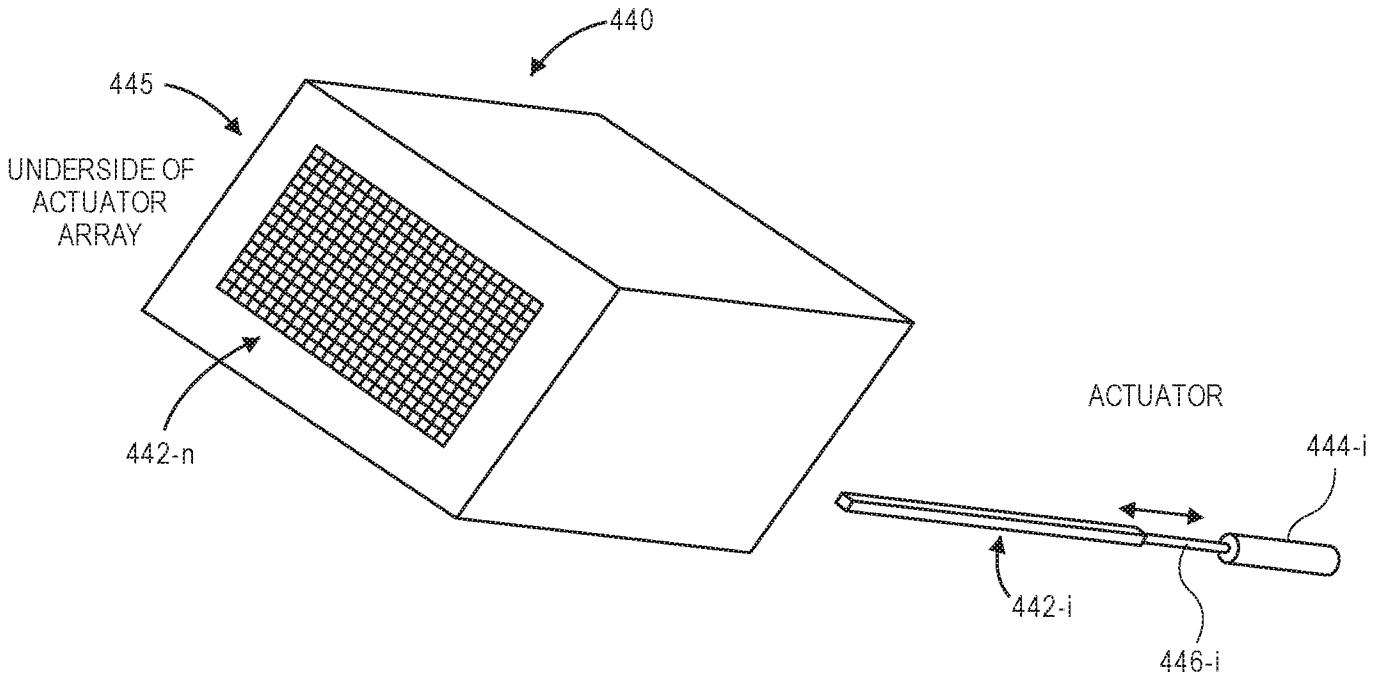
FIGS. 4A through 4D are views of aspects of systems for fabricating thermoformed cavities for packaging items in accordance with embodiments of the present disclosure.

As is shown in FIG. 4A, an actuator system 440 includes a plurality of actuators 442-*n* arranged within a housing (or frame) 445. Each of the individual actuators 442-*i* is coupled to a motor 444-*i* by a shaft 446-*i* or other member. The actuators 442-*i* may be formed from any selected materials having desired properties for coming into contact with a thermoplastic material (e.g., a thermoplastic film) and being retracted therefrom. For example, in some embodiments, the actuators 442-*i* may be formed from metals such as steel (e.g., stainless steel), aluminum or alloys thereof. In some other embodiments, the actuators 442-*i* may be formed from plastics (e.g., polyethylenes, polypropylenes, polystyrenes and polyvinyl chlorides), rubbers (e.g., natural or synthetic rubbers such as acrylics, butadiene rubbers, butyl rubbers, chloroprenes, fluorocarbons, fluoroelastomers, fluorosilicones, monomers of ethylenes or propylenes, nitrile rubbers, perfluoroelastomers, polyethylenes, polyurethanes, silicone rubbers, styrene rubbers), or other metals (e.g., brass, copper, steel, titanium or alloys thereof), or the like. Furthermore, in some embodiments, each of the individual actuators 442-*i* may be homogenous in nature, and formed from a common material having common cross-sectional areas and common lengths. In some other embodiments, however, the individual actuators 442-*i* may be heterogeneous in nature, and two or more of the individual actuators 442-*i* may be formed from different materials having different cross-sectional areas and different lengths. Similarly, the motors 444-*i* may be linear induction motors, servo motors, or any other motors. Alternatively, in lieu of the motors 444-*i*, or in addition to the motors 444-*i*, the actuators 442-*i* may be operated by one or more pressurized cylinders or other systems that may control a distance by which the actuators 442-*i* are extended into a thermoplastic material based on pressure (e.g., air, hydraulic) supplied by such cylinders or systems. Any type of prime mover may be coupled to the actuators 442-*i* by way of the shafts 446-*i* or another implement to cause the actuators 442-*i* to be selectively extended into thermoplastic material in accordance with the present disclosure.

The individual actuators 442-*i* may be caused to extend by a selected distance, e.g., into a thermoplastic film, by providing one or more control signals to the respective motors 444-*i*. Furthermore, as is shown in FIG. 4A, when each of the actuators 442-*n* is in a neutral position, tips of the actuators 442-*n* are arranged in a common plane, and may be selectively programmed based on information or data regarding an item to extend into a thermoplastic film provided in close proximity to the common plane to fabricate a cavity for the item within the thermoplastic film.

In some embodiments, the actuator system 440 may include a differential pressure system within the housing 445, or external to the housing 445, for creating a differential pressure across a thermoplastic material with one or more of the individual actuators 442-*i* extended therein. For example, the actuator system 440 may include a vacuum pump or other component provided within the housing 445 for drawing a vacuum on a thermoplastic material, and thereby enhancing the contact between the thermoplastic material and the contact points of the respective actuators 442-*i*. Alternatively, or additionally, a blower or other component may be provided external to the housing 445, and opposite a thermoplastic material in contact with one or more of the individual actuators 442-*i*, for providing pressure on the thermoplastic material, and thereby enhancing the contact between the thermoplastic material and the contact points of the respective actuators 442-*i*.

Figure 4B:
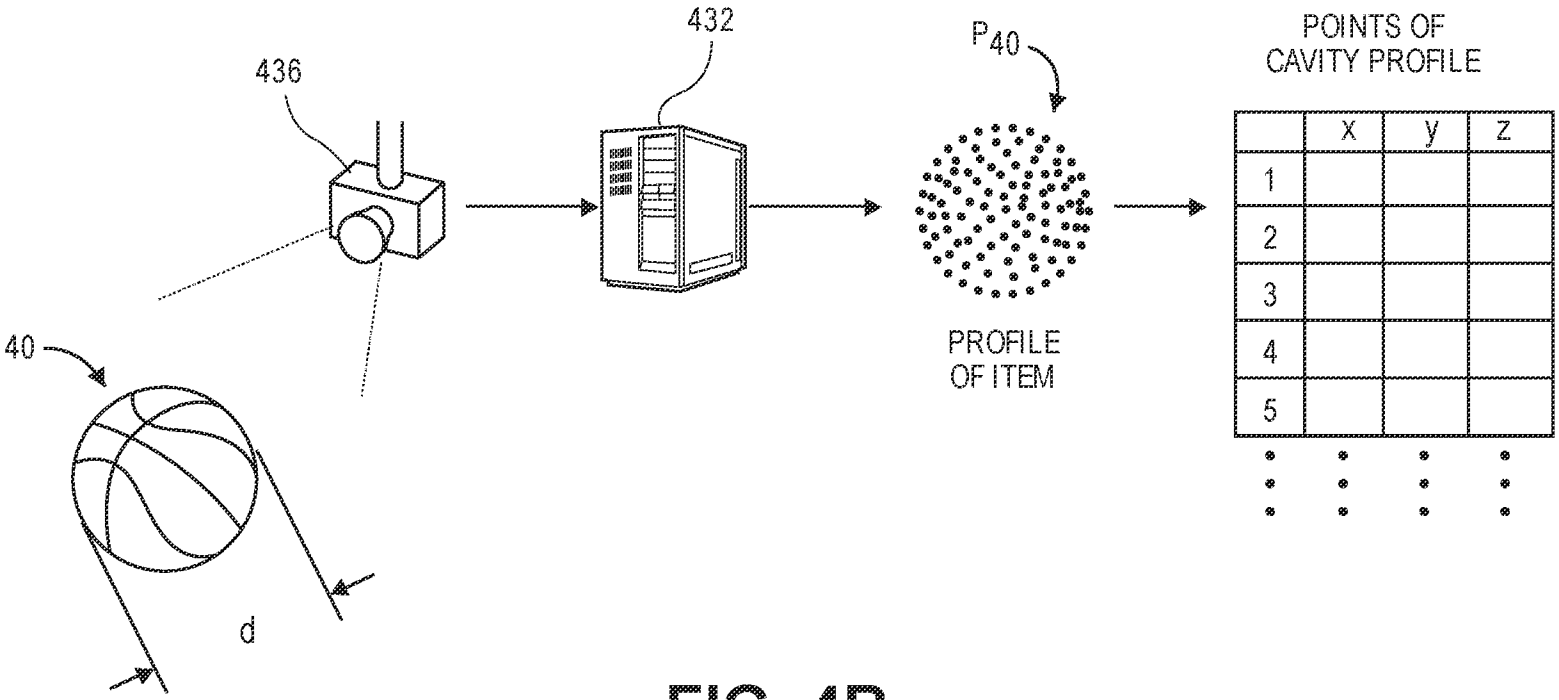

As is shown in FIG. 4B, one or more dimensions of an item 40, e.g., a diameter d of the item 40, may be determined based on data captured from the item 40 by an imaging device (or other sensor) 436. For example, the data may be processed to determine the diameter d or other dimensions of the item 40 from the data directly or, alternatively, to interpret one or more identifiers provided on external surfaces of the item 40, to identify the item 40 based on one or more of the interpreted identifiers, and to access the diameter d or other dimensions of the item 40 from records maintained in one or more data stores. A server 432 in communication with the imaging device 436 may process the data and generate a profile $P_{40}$ of the item 40 based on such data. From the profile $P_{40}$ of the item, points of a profile of a cavity to be fabricated from a thermoplastic film may be determined.

Figure 4C:
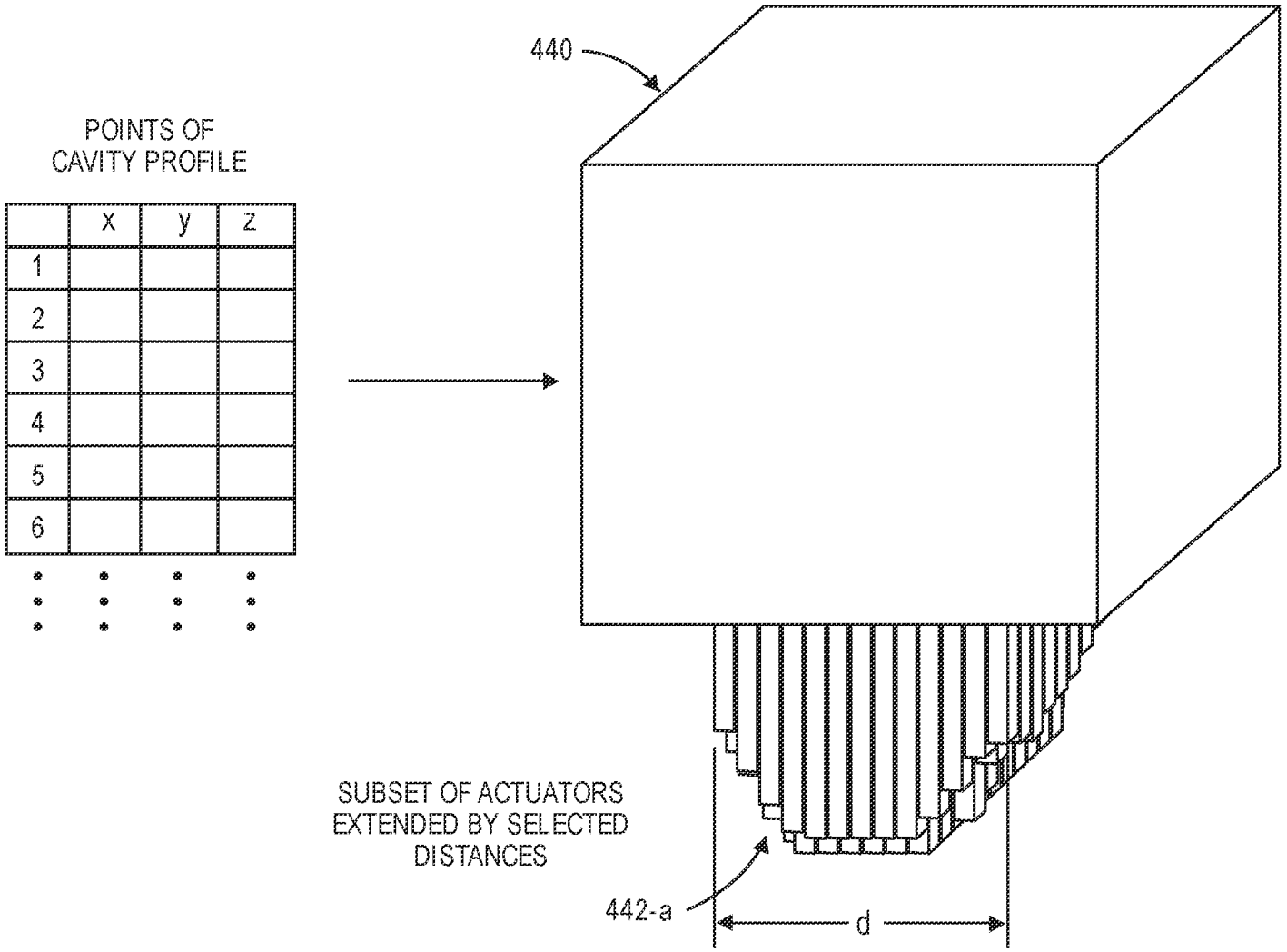
Figure 4D:
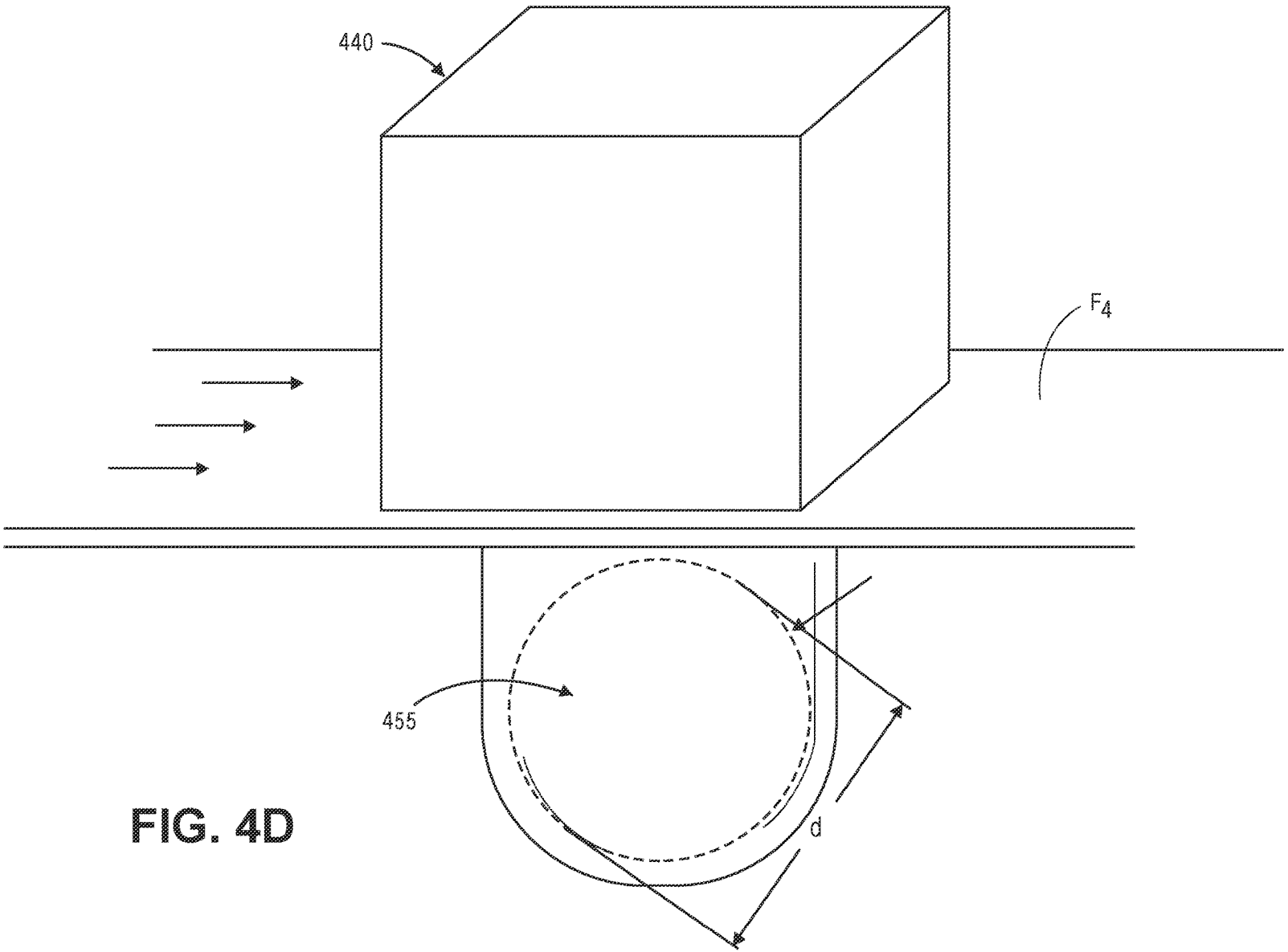

As is shown in FIG. 4C, the actuator system 440 may be programmed to select a subset 442-*a* of the actuators 442-*n*, and to extend the selected actuators 442-*a* of the subset by selected distances in order to fabricate a cavity within thermoplastic material that may accommodate at least the diameter d of the item 40. As is shown in FIG. 4D, a thermoplastic film $F_4$ or other thermoplastic material may be translated in close proximity to the underside of the actuator system 440, and the actuators 442-*a* of the subset may be extended into the thermoplastic film $F_4$ by the selected distances in order to fabricate a cavity 455 therein. In some embodiments, the thermoplastic film $F_4$ may be provided at elevated temperatures as the actuators 442-*a* of the subset are extended therein. In some embodiments, the thermoplastic film $F_4$ may then be allowed to cool, e.g., to a setting temperature, or to ambient temperatures, prior to retracting the actuators 442-*a* of the subset therefrom. In some embodiments, a differential pressure may be applied across the thermoplastic film $F_4$ with the actuators 442-*a* extended therein, in order to enhance the contact between the thermoplastic film $F_4$ and contact points of the actuators 442-*a*.

Figure 5A:
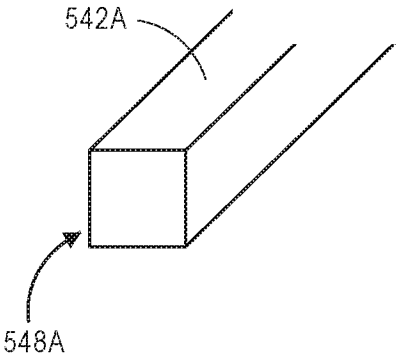
FIGS. 5A through 5C are views of aspects of systems for fabricating thermoformed cavities for packaging items in accordance with embodiments of the present disclosure.
Figure 5B:
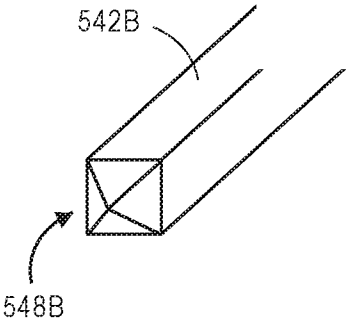
Figure 5C:
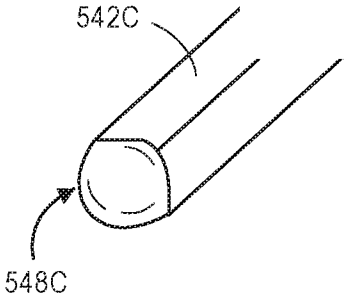

In accordance with the present disclosure, actuators that come into contact with thermoplastic films to fabricate cavities therein may have tips or other contact points or faces that have various shapes or dimensions. Referring to FIGS. 5A through 5C, views of aspects of systems for fabricating thermoformed cavities for packaging items in accordance with embodiments of the present disclosure are shown. Except where otherwise noted, reference numerals preceded by the number "5" in FIGS. 5A through 5C refer to elements that are similar to elements having reference numerals preceded by the number "4" in FIGS. 4A through 4D, by the number "2" in FIG. 2 or by the number "1" shown in FIGS. 1A through 1J.

As is shown in FIG. 5A, an actuator 542A has a substantially flat face 548A. As is shown in FIG. 5B, an actuator 542B has a tip 548B having a substantially pyramidal shape. Alternatively, the tip 548B may have a conic shape, or any other type or form of pointed shape, including but not limited to pyramids having polygons other than squares as bases. For example, where an actuator has a cross-section in the shape of a triangle, a pentagon or a hexagon, the actuator may have a tip in the form of a triangular-based pyramid, a pentagonal-based pyramid, or a hexagonal-based pyramid. In some embodiments, a shape of a tip or other contact point or face of an actuator may, but need not, correspond to a shape of a cross-section of the actuator. As is shown in FIG. 5C, an actuator 542C includes an end 548C having a substantially bulbous or hemispheric shape. Alternatively, the tip 548C may have a parabolic, elliptical or any other type or form of rounded shape.

Figure 6A:
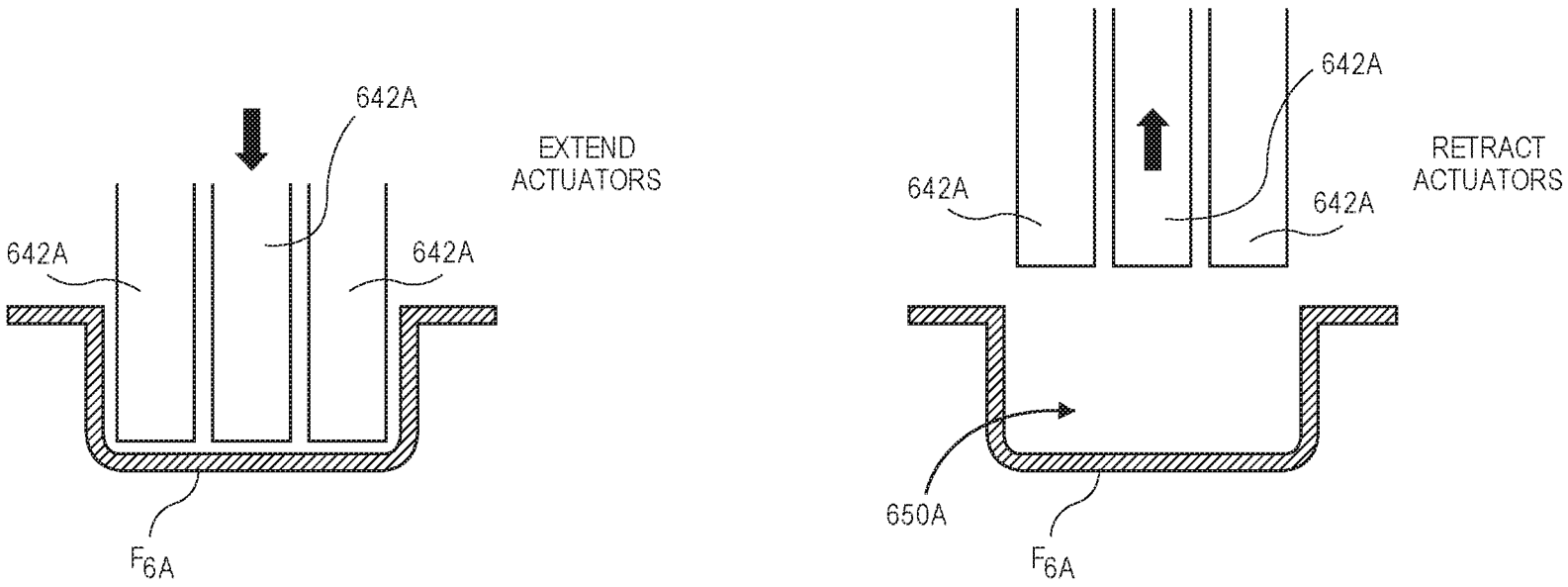
FIGS. 6A through 6C are views of aspects of systems for fabricating thermoformed cavities for packaging items in accordance with embodiments of the present disclosure.
Figure 6B:
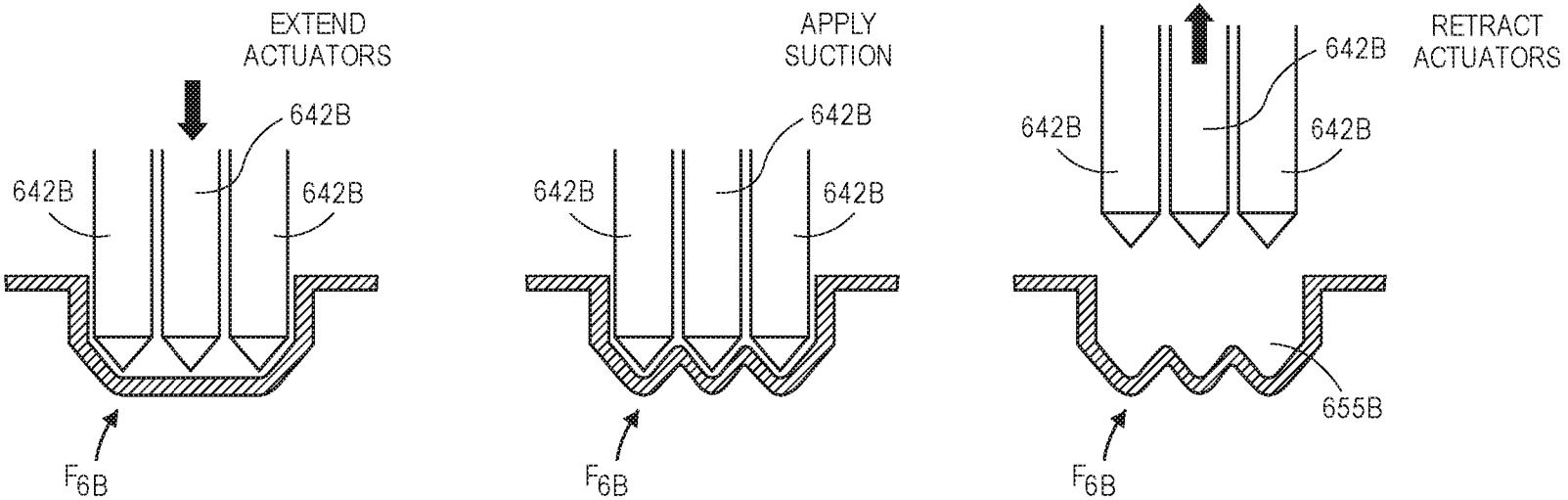
Figure 6C:
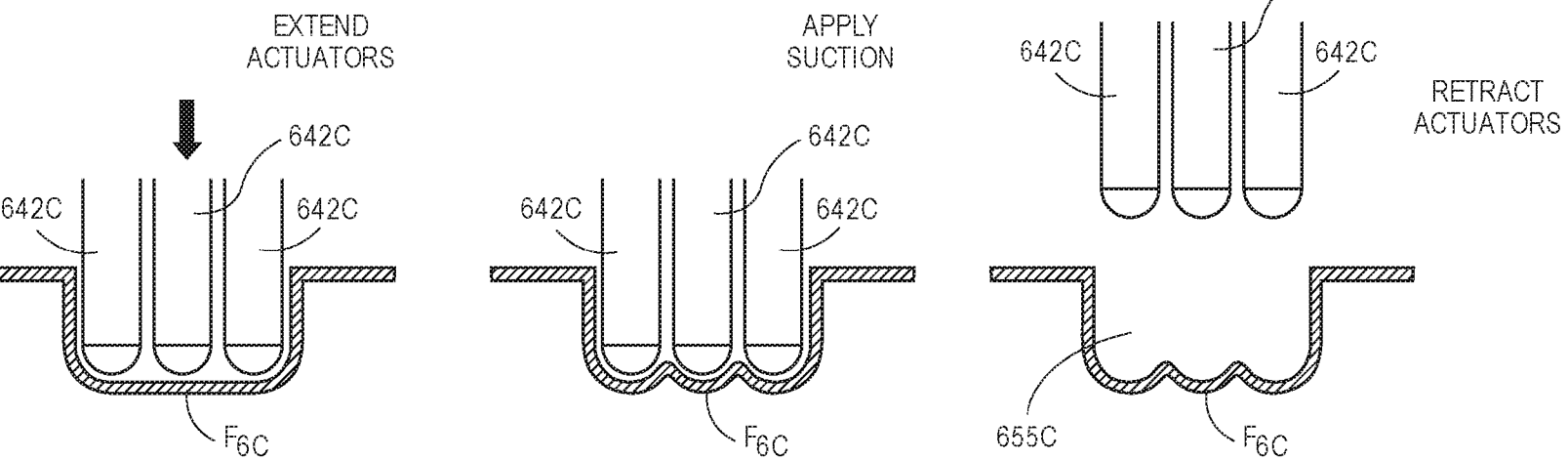

Shapes of tips or other contact points or faces of actuators of an array may determine a surface texture of a cavity fabricated by extending such actuators into thermoplastic material. Referring to FIGS. 6A through 6C, views of aspects of systems for fabricating thermoformed cavities for packaging items in accordance with embodiments of the present disclosure are shown. Except where otherwise noted, reference numerals preceded by the number "6" in FIGS. 6A through 6C refer to elements that are similar to elements having reference numerals preceded by the number "5" in FIGS. 5A through 5C, by the number "4" in FIGS. 4A through 4D, by the number "2" in FIG. 2 or by the number "1" shown in FIGS. 1A through 1J.

As is shown in FIG. 6A, each of a plurality of actuators 642A having substantially flat faces, similar to the actuator 542A of FIG. 5A, may be extended by selected distances into a thermoplastic film $F_{6A}$ in order to fabricate a cavity 650A therein. An internal surface of the cavity 650A thus has a shape and surface texture corresponding to the plurality of faces 648A of the actuators 642A extended therein. In some embodiments, as the actuators 642A are extended into the thermoplastic film $F_{6A}$, the thermoplastic film $F_{6A}$ may be maintained at an elevated temperature with respect to ambient. After the actuators 642A have been extended into the thermoplastic film $F_{6A}$, however, the thermoplastic film $F_{6A}$ may be permitted to cool to a setting temperature of the film $F_{6A}$, or to an ambient temperature, e.g., by supplying one or more bursts of substantially cool air to external surfaces of the film $F_{6A}$ prior to retracting the actuators 642A therefrom, or in any other manner.

As is shown in FIG. 6B, each of a plurality of actuators 642B having tips 648B with a substantially pyramidal shape, similar to the actuator 542B of FIG. 5B, may be extended by selected distances into a thermoplastic film $F_{6B}$ in order to fabricate a cavity 655B therein. The extension of the plurality of actuators 642B into the film $F_{6B}$ forms a cavity having an angled or beveled perimeter consistent with the shapes of the tips 648B of the actuators 642B. With the actuators 642B extended into the film $F_{6B}$, a negative pressure differential may be provided across the film $F_{6B}$ by applying suction on the side of the actuators 642B, thereby causing the film $F_{6B}$ to be drawn toward the actuators 642B, and forming depressions in the film $F_{6B}$ between the tips 648B of the various actuators 642B. An internal surface of the cavity 655B thus has a dimpled shape characterized by the depressions formed in the film $F_{6B}$ by the plurality of tips 648B of the actuators 642B.

Similarly, as is shown in FIG. 6C, each of a plurality of actuators 642C having ends 648C with a substantially bulbous or hemispheric shape may be extended by selected distances into a thermoplastic film $F_{6C}$ in order to fabricate a cavity 655C therein. The extension of the plurality of actuators 642C into the film $F_{6C}$ forms a cavity having a rounded perimeter consistent with the shapes of the tips 648C of the actuators 642C. With the actuators 642C extended into the film $F_{6C}$, a negative pressure differential may be provided across the film $F_{6C}$ by applying suction on the side of the actuators 642C, thereby causing the film $F_{6C}$ to be drawn toward the actuators 642C, and forming depressions in the film $F_{6C}$ between the ends 648C of the various actuators 642C. An internal surface of the cavity 655C likewise has a dimpled or pock-marked shape characterized by the depressions formed in the film $F_{6C}$ by the plurality of ends 648C of the actuators 642C.

Although each of the cavities 655A, 655B, 655C shown in FIGS. 6A through 6C is shown as having been formed by pluralities of homogenous actuators 642A, 642B, 642C having common cross-sectional areas and common faces or tips, those of ordinary skill in the pertinent arts will recognize that the actuator systems of the present disclosure may include heterogeneous actuators having different cross-sectional areas or different faces or tips.

The actuator systems of the present disclosure may fabricate cavities for items based on any intrinsic or extrinsic data regarding the items. For example, a cavity may be fabricated from thermoplastic film based not only on dimensions of an item or a preferred alignment of the item but also attributes of the item such as a mass or a weight of the item, contents of the item (e.g., whether the item includes glass or other fragile materials), handling instructions for the item, conditions under which the item is to be maintained, or any other subjective or objective factor regarding the item. Referring to FIGS. 7A through 7D, views of aspects of systems for fabricating thermoformed cavities for packaging items in accordance with embodiments of the present disclosure are shown. Except where otherwise noted, reference numerals preceded by the number "7" in FIGS. 7A through 7D refer to elements that are similar to elements having reference numerals preceded by the number "6" in FIGS. 6A through 6C, by the number "5" in FIGS. 5A through 5C, by the number "4" in FIGS. 4A through 4D, by the number "2" in FIG. 2 or by the number "1" shown in FIGS. 1A through 1J.

Figure 7A:
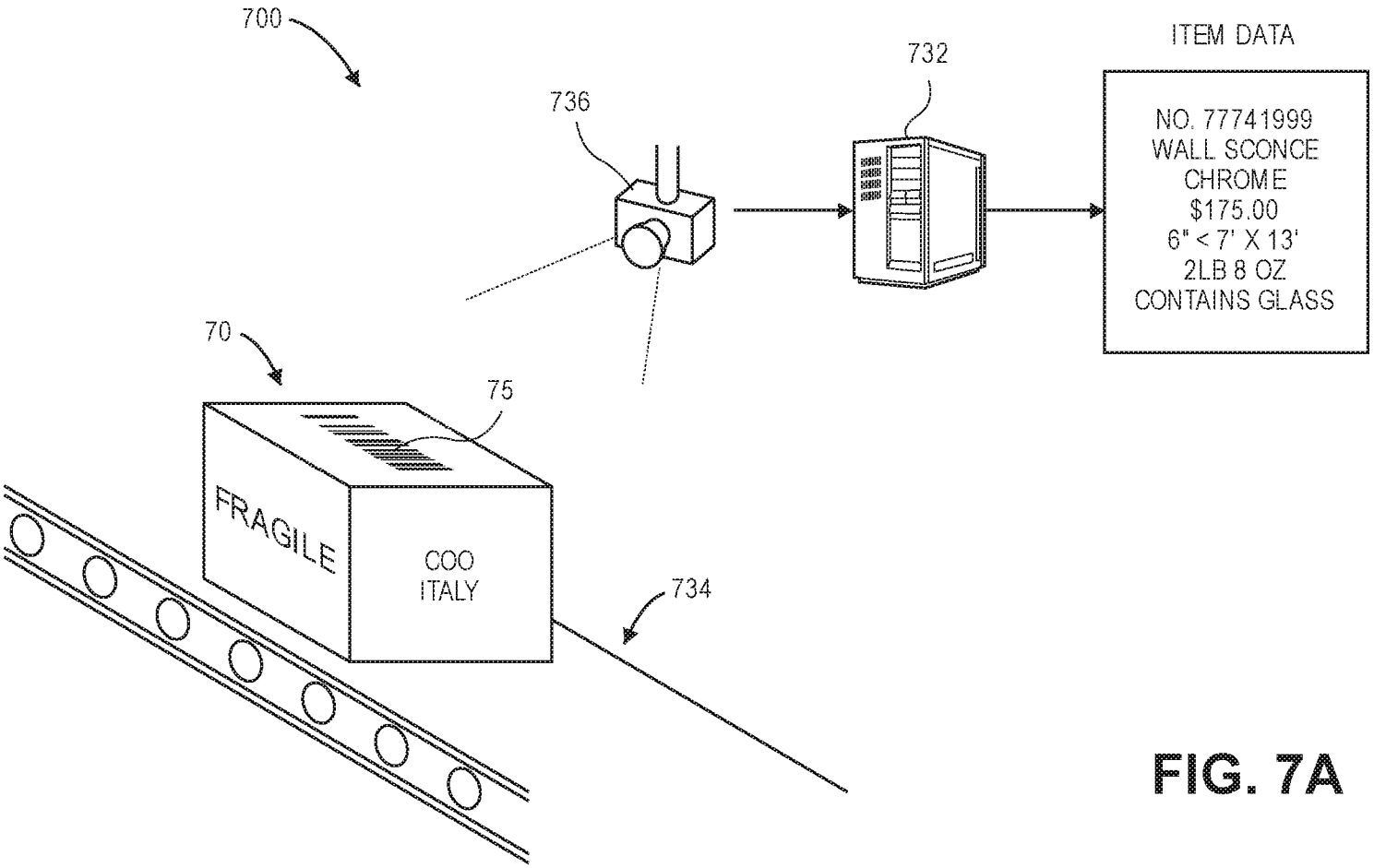
FIGS. 7A through 7D are views of aspects of systems for fabricating thermoformed cavities for packaging items in accordance with embodiments of the present disclosure.

As is shown in FIG. 7A, a system 700 includes a server 732, a conveying system 734 and a sensor 736 (e.g., an imaging device). The server 732 is in communication with each of the conveying system 734 and the sensor 736, and is configured to control their respective operations by one or more control signals. The conveying system 734 has an item 70 traveling thereon and the sensor 736 includes at least a portion of the conveying system 734 within a field of view or operating range. As is shown in FIG. 7A, based on data captured by the sensor 736, the server 732 may identify data regarding the item 70, including but not limited to identifiers of the item 70, such as a name and an item number of the item 70, as well as materials included in the item 70 (e.g., chrome, glass), a price of the item 70, dimensions of the item 70, and a mass of the item 70.

Figure 7B:
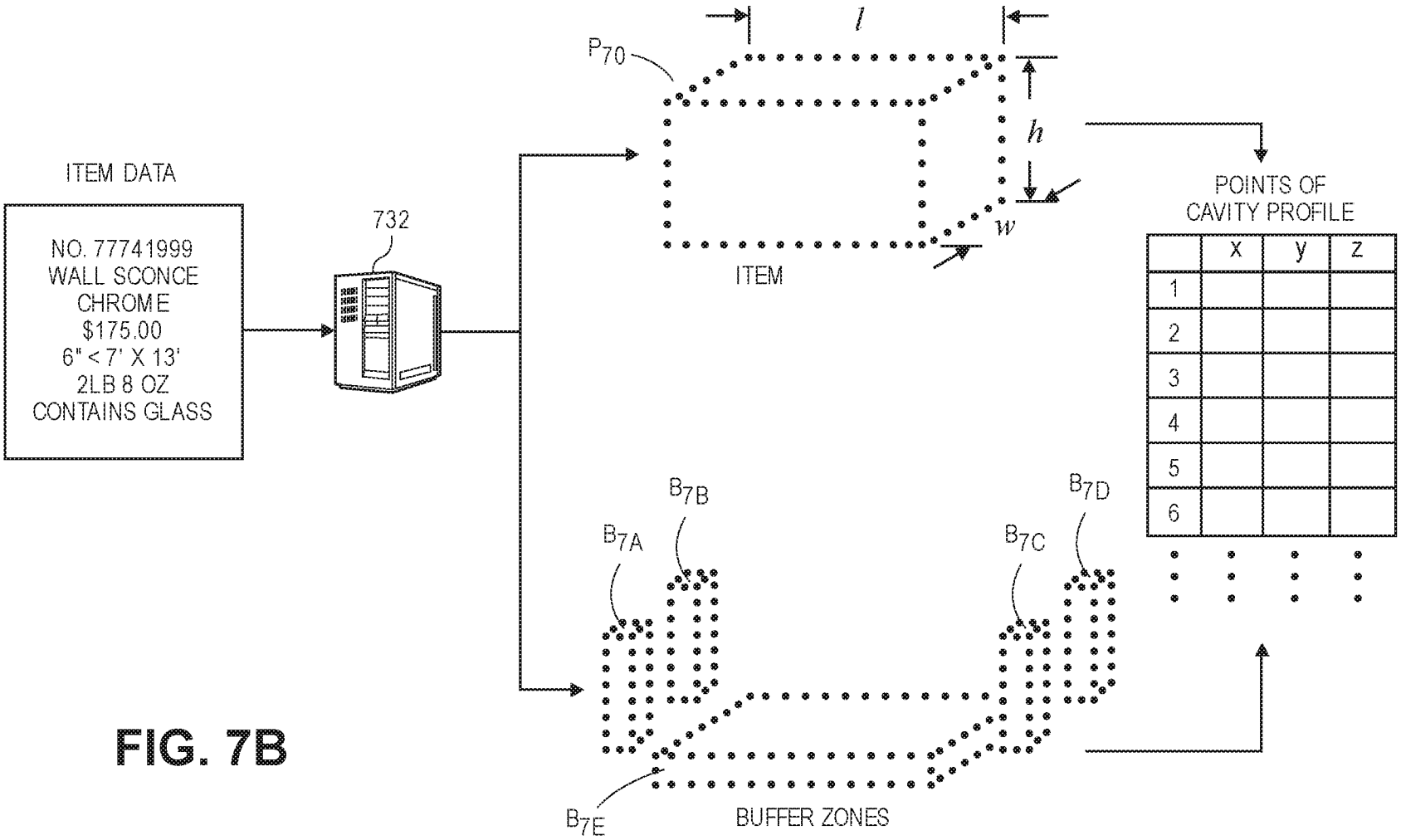

As is shown in FIG. 7B, the data regarding the item 70 may be used to generate a profile $P_{70}$ of the item 70, as well as buffer zones (or spatial barriers) $B_{7A}$, $B_{7B}$, $B_{7C}$, $B_{7D}$ to be provided around a cavity fabricated from a thermoplastic film for the item 70 and a buffer zone $B_{7E}$ to be provided below the item in the cavity. Based on the profile $P_{70}$, as well as the buffer zones $B_{7A}$, $B_{7B}$, $B_{7C}$, $B_{7D}$, $B_{7E}$, points of a profile for the cavity may be defined. Such points may include coordinates of one or more edges or vertices of the cavity, as well as representative points on one or more surfaces of the cavity, e.g., vertices of triangles of a mesh representative of the cavity and any buffer zones for aspects of the item 70.

Figure 7C:
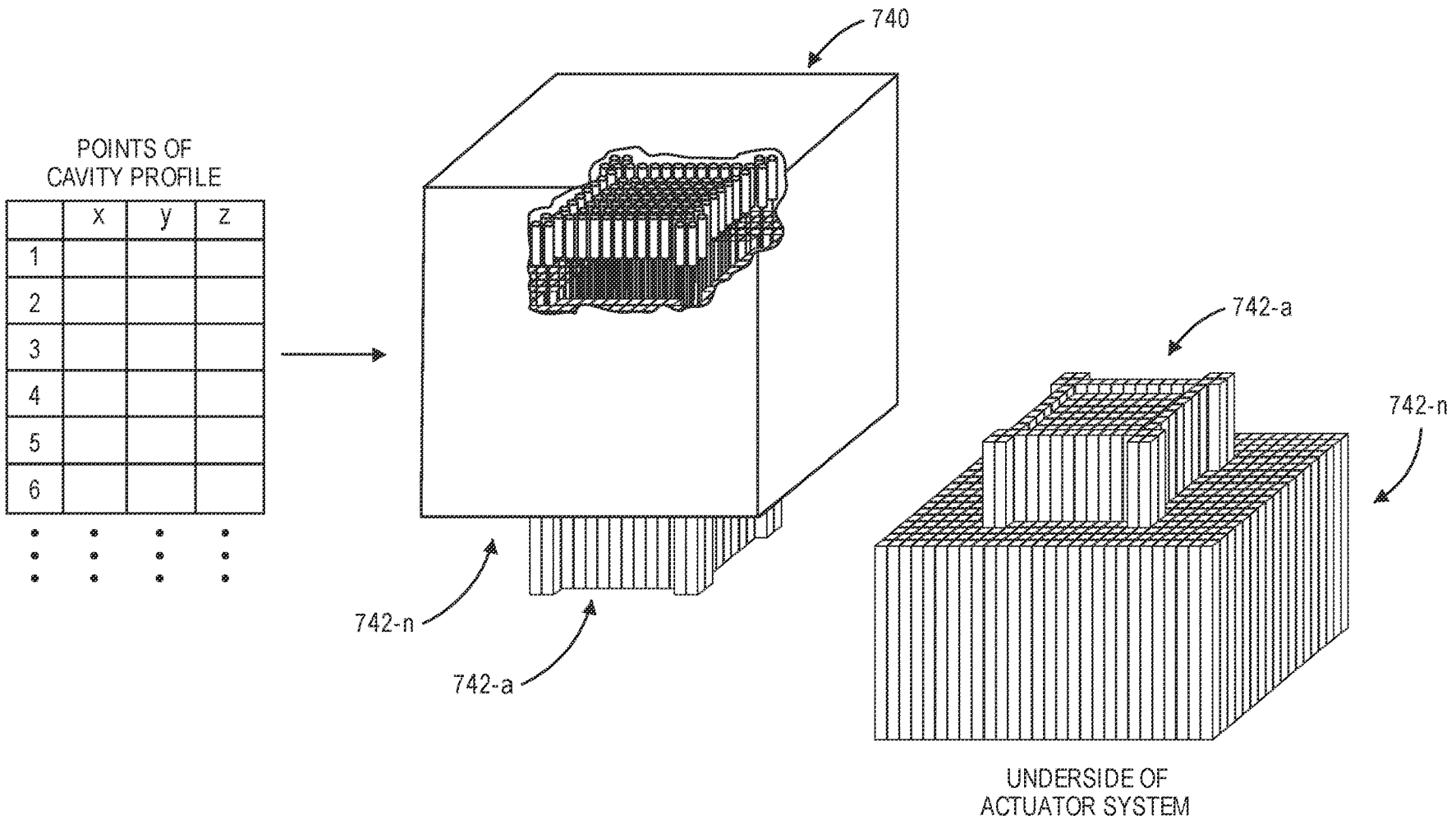
Figure 7D:
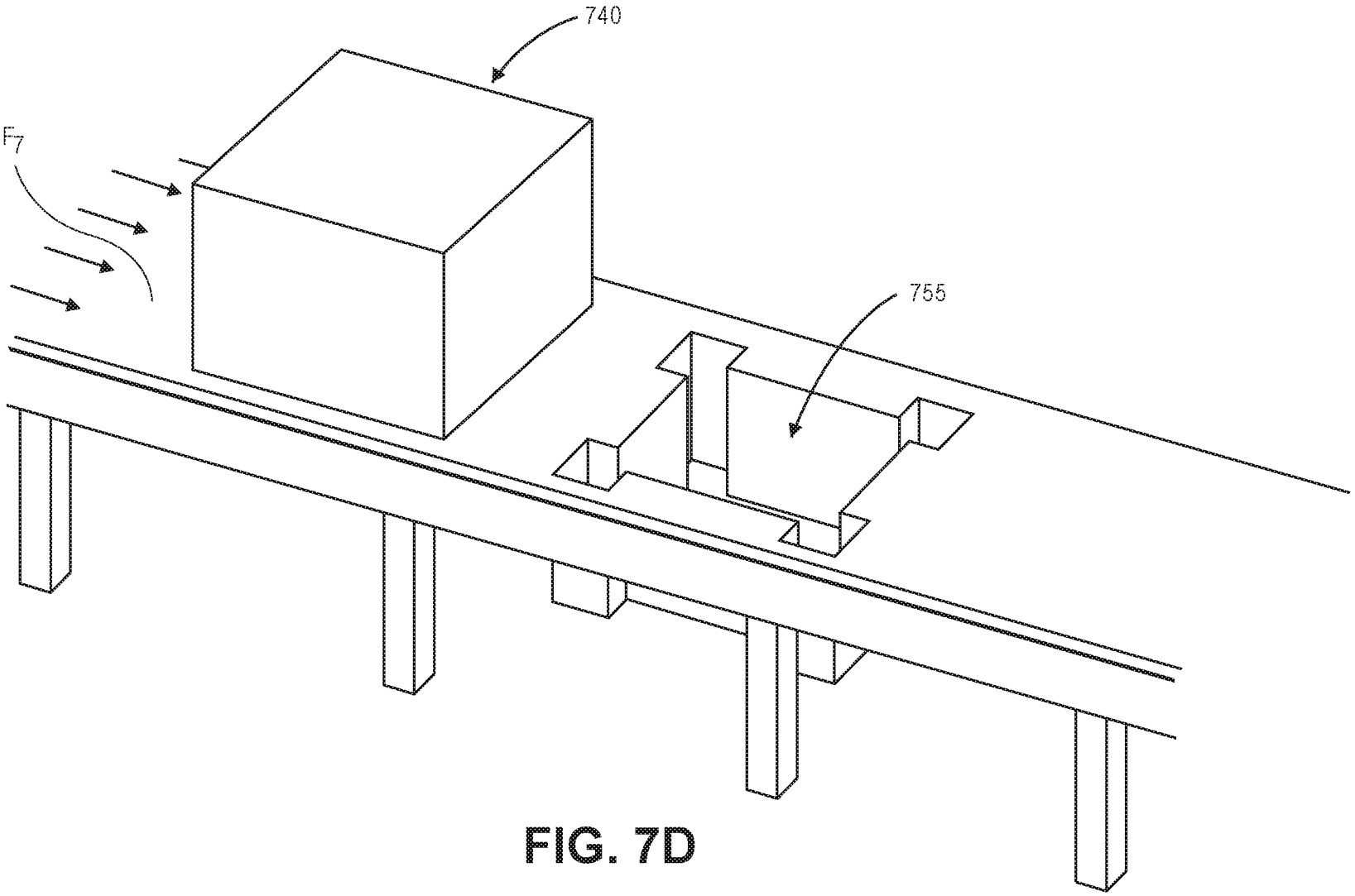

As is shown in FIG. 7C, an actuator system 740 having a plurality of actuators 742-*n* may be programmed with the profile of the cavity. A subset 742-*a* of the actuators 742-*n* may be identified, and distances by which the subset 742-*a* of the actuators 742-*n* are to be extended, may be selected based on the profile of the cavity. As is shown in FIG. 7D, the subset 742-*a* of the actuators 742-*n* may be extended into a thermoplastic film $F_7$, and, upon their retraction, may define a cavity 755 that is sized to accommodate the item 70 and includes the buffer zones $B_{7A}$, $B_{7B}$, $B_{7C}$, $B_{7D}$, $B_{7E}$.

Figure 8A:
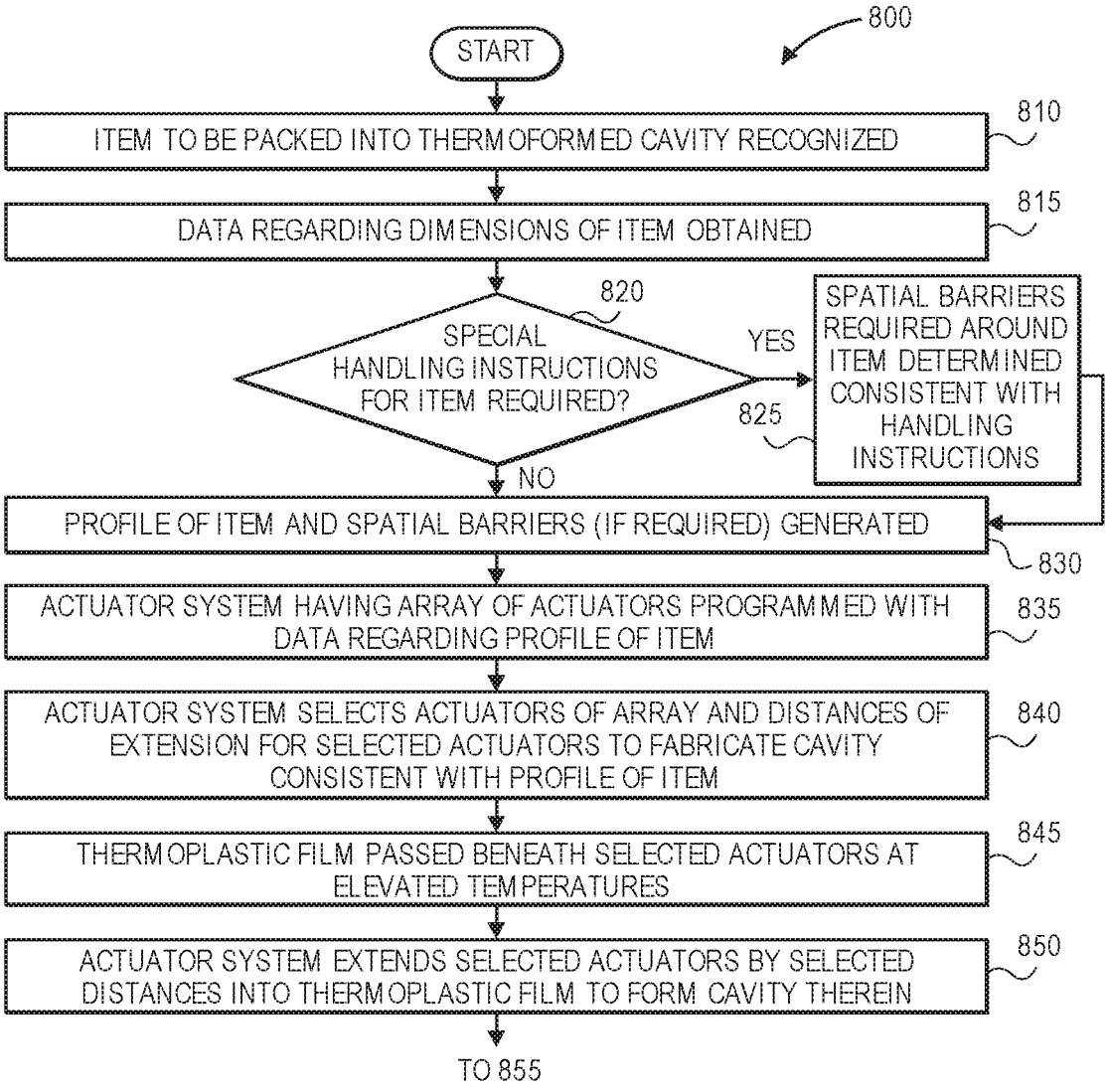
FIGS. 8A and 8B are a flow chart of one process for fabricating thermoformed cavities for packaging items in accordance with embodiments of the present disclosure.
Figure 8B:
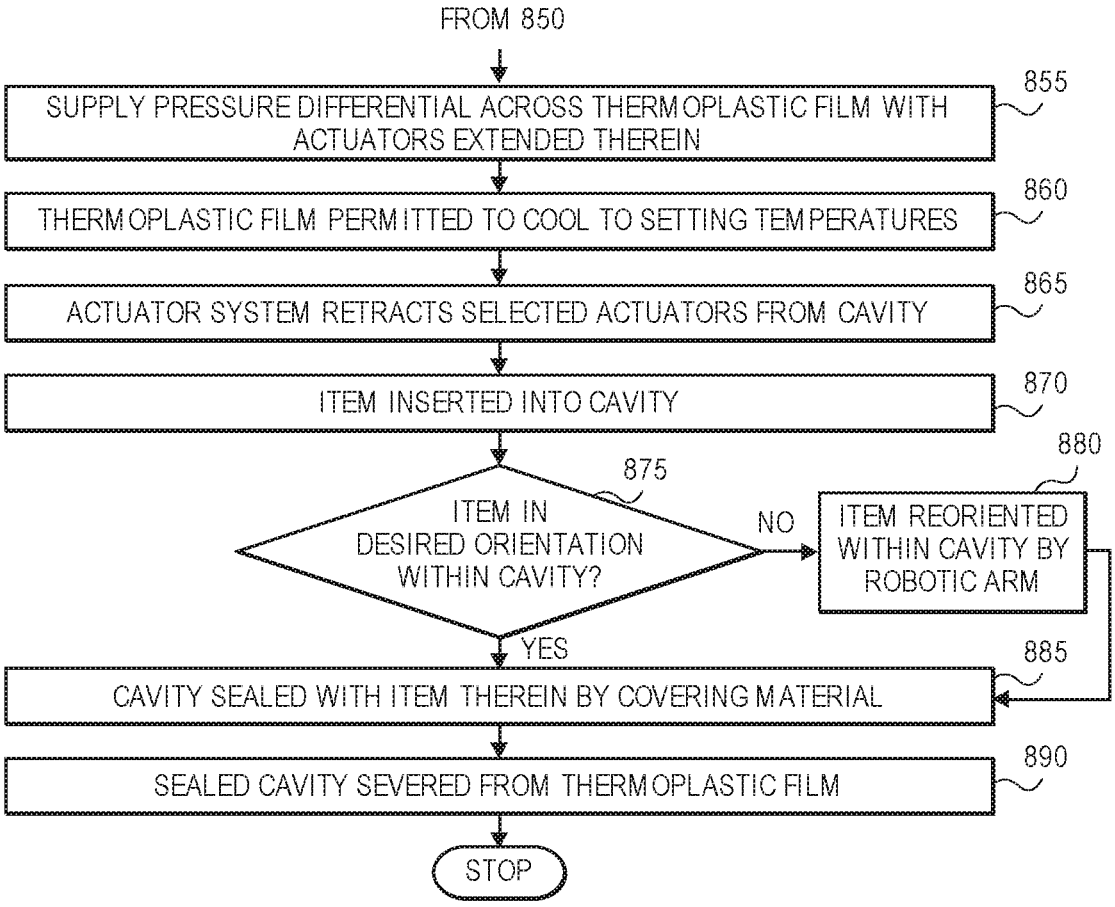

The packaging systems of the present disclosure may be incorporated into fulfillment processes and utilized in preparing and packing items for shipment in response to orders. Referring to FIGS. 8A and 8B, a flow chart 800 of one process for fabricating thermoformed cavities for packaging items in accordance with embodiments of the present disclosure is shown.

At box 810, an item to be packed into a thermoformed cavity is recognized. For example, referring again to FIG. 1B, an item may be recognized based on an analysis of one or more images, which may be processed to identify one or more edges, contours or outlines of the item, or to interpret any marked identifiers (e.g., bar codes) appearing therein. At box 815, data regarding dimensions of the item is obtained. For example, the dimensions may be automatically determined from data captured regarding the item, or from data identified based on an identifier of the item, e.g., an interpreted bar code associated with the item or alphanumeric characters visible on surfaces of the item, from one or more records or files maintained in a data store. Alternatively, an identifier of the item, or dimensions of the item, may be manually provided to a computer device by a human operator, by way of one or more input/output interfaces.

At box 820, whether any special handling instructions are required for the item is determined. Such handling restrictions may be identified or determined in any manner, including but not limited to based on any information or data that may be determined regarding the item, e.g., by one or more sensors. If any special handling instructions are required for the item, then the process advances to box 825, where one or more spatial barriers that are required around the item, consistent with the handling instructions, are determined. For example, where the item includes one or more fragile or sensitive features, sharp corners or edges, or other aspects that require enhanced protection, attributes of the one or more barriers, e.g., dimensions, shapes, orientations, or other attributes, may be determined.

If there are no special handling instructions required for the item, or after profiles of one or more barriers are determined, the process advances to box 830, where a profile of the item and the one or more barriers is generated. The profile may take the form of a point cloud or other three-dimensional representation (e.g., a mesh) of surface features of the item, and of the one or more barriers that are to be provided about the item, and data regarding the profile may be stored in one or more records or files. At box 835, an actuator system having an array of actuators is programmed with data regarding the profile of the cavity, including the item and any spatial barriers. The data may include coordinates of one or more edges or vertices of the cavity, as well as representative points on one or more surfaces of the cavity, e.g., vertices of triangles of a mesh representative of the cavity including any spatial barriers for aspects of the item.

At box 840, the actuator system selects actuators of the array, and distances by which the selected actuators are to be extended, to fabricate a cavity consistent with the profile in a thermoplastic film. For example, where the item is to be packaged in a predetermined orientation, the actuators may be selected for fabricating the cavity based on a cross-sectional area of the item in the predetermined orientation, as well as cross-sectional areas of any spatial barriers for the item with the item in the predetermined orientation. Likewise, the distances by which the selected actuators are to be extended into a thermoplastic film may be selected based on heights of the item in the predetermined orientation, with respect to the cross-sectional area.

At box 845, a thermoplastic film is passed beneath at least the selected actuators at elevated temperatures, e.g., with respect to ambient temperatures. The thermoplastic film may be translated beneath the tips of the selected actuators by one or more spools, in one or more sheets, or in any other manner. Alternatively, where the actuators of the actuator system are aligned in non-vertical orientations, the thermoplastic film may be passed alongside or above tips of the respective actuators. At box 850, the actuator system extends the selected actuators into the thermoplastic film by the selected distances to form a cavity consistent with the profile of the item and any spatial barriers. For example, the actuators of the actuator system may be individually programmed or addressed to extend by their respective distances, e.g., in response to one or more control signals provided to motors, pneumatic systems or any other prime movers associated with the respective actuators.

At box 855, a pressure differential is supplied across the thermoplastic film with the actuators extended therein. As is discussed above, supplying a pressure differential (e.g., a vacuum or positive pressure) across the thermoplastic film enhances the contact between the thermoplastic film and the selected actuators and may, depending on the shapes of the contact points of the actuators, impart one or more features into the thermoplastic film. At box 860, the thermoplastic film is permitted to cool to a setting temperature, e.g., by applying one or more bursts of air at substantially cooler temperatures to an opposite side of the thermoplastic film from the extended actuators. Alternatively, the thermoplastic film may be cooled by convective heat transfer to any fluid other than air, or by conductive heat transfer to any substance. In some embodiments, the cooling of the thermoplastic film at box 860 may be accomplished, at least in part, by the means by which the pressure differential is supplied across the thermoplastic film (e.g., by blowing air onto or sucking air from one side of the thermoplastic film).

At box 865, the actuator system retracts the selected actuators from the cavity. For example, the actuator system may provide one or opposite control signals to the respective motors, pneumatic systems or any other prime movers associated with the respective actuators, thereby causing the actuators to retract by at least the distances into which the actuators were extended into the thermoplastic film. At box 870, the item is inserted into the newly thermoformed cavity, e.g., by one or more human operators or machines, such as one or more robotic arms, or, alternatively, by allowing the item to drop into the cavity by gravity. For example, referring again to FIG. 1F, the item 10 drops off an end (or terminus) or other portion of the conveying system 134 and into the cylindrical cavity 155 formed into the film $F_1$. Alternatively, the item 10 may be transferred into the cylindrical cavity 155 from the conveying system 134 by one or more diverters or diversion systems, which may push or otherwise transfer the item 10 into the cylindrical cavity 155.

At box 875, whether the item is in a desired orientation within the cavity is determined. For example, as is discussed above, the cavity may be fabricated for the item based on a profile of the item and any spatial barriers with the item in a specific orientation. Whether the item is in the specific orientation may be determined by manual or visual inspection, by computer vision (e.g., based on data captured by one or more sensors), or by any other technique. If the item is not in the desired orientation within the cavity, then the process advances to box 880, where the item is reoriented within the cavity, e.g., by one or more workers or machines, such as one or more robotic arms, diverters or other implements.

If the item is in the desired orientation within the cavity, or after the item has been placed into the desired orientation within the cavity, the process advances to box 885, where the cavity is sealed with the item therein by one or more covering materials. For example, in some embodiments, the cavity may be sealed and/or enclosed by one or more other thermoplastic films, which may be heat-sealed to one or more edges or other surfaces of the cavity. In some other embodiments, the cavity may be sealed or enclosed by one or more friction-fit covers. In accordance with the present disclosure, the cavity may be sealed or enclosed in an airtight or watertight manner or, alternatively, enclosed in a manner that is neither airtight nor watertight. Alternatively, or additionally, the item may be accompanied by one or more packing slips, order summaries, receipts, sets of instructions or any other documents that may be printed previously or in conjunction with the fabrication of the cavity.

At box 890, the sealed cavity is severed from the thermoplastic film, and the process ends. For example, one or more cutting implements (e.g., knives, blades or other systems) may be operated by a worker or a machine to sever the sealed cavity from a balance of the thermoplastic film, which may then be discarded or recycled. The sealed cavity may then be transported to an intended destination for the item by one or more carriers such as cars, trucks, trailers, freight cars, container ships or cargo aircraft (e.g., manned aircraft or unmanned aircraft, such as drones).

Figure 9:
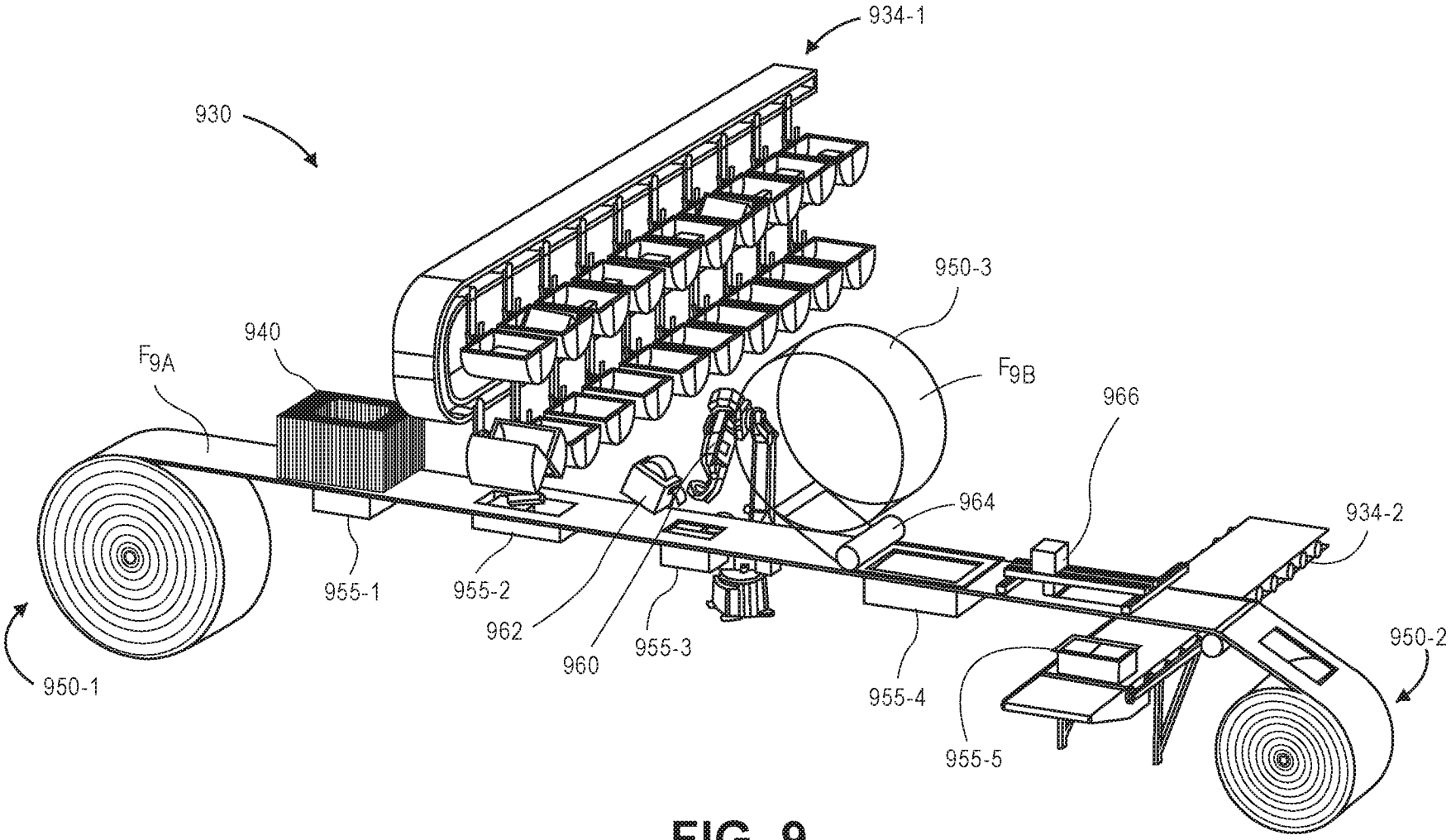
FIG. 9 is a view of aspects of one system for fabricating thermoformed cavities for packaging items in accordance with embodiments of the present disclosure.

The system for fabricating thermoformed cavities for packaging items in accordance with embodiments of the present disclosure may be incorporated into processes that may be partially or even entirely automated. Referring to FIG. 9, a view of aspects of one system for fabricating thermoformed cavities for packaging items in accordance with embodiments of the present disclosure is shown. Except where otherwise noted, reference numerals preceded by the number "9" in FIG. 9 refer to elements that are similar to elements having reference numerals preceded by the number "7" in FIGS. 7A through 7D, by the number "6" in FIGS. 6A through 6C, by the number "5" in FIGS. 5A through 5C, by the number "4" in FIGS. 4A through 4D, by the number "2" in FIG. 2 or by the number "1" shown in FIGS. 1A through 1J.

As is shown in FIG. 9, a system 900 includes a packaging system 930 having a pair of conveying systems 934-1, 934-2, an actuator system 940, a feed spool 950-1 and a take-up spool 950-2 for thermoplastic film $F_{9A}$. The packaging system 930 further includes a feed spool 950-3 for a cover film $F_{9B}$ to be applied over cavities fabricated into the thermoplastic film $F_{9A}$ by the actuator system 940, as well as a robotic arm 960, a printer 962, a sealing system 964 and a cutting implement 966.

The feed spool 950-1 is aligned upstream of the actuator system 940 and configured to discharge the thermoplastic film $F_{9A}$ downstream to the actuator system 940. The take-up spool 950-2 is aligned downstream of the actuator system 940 and the robotic arm 960, the printer 962, the sealing system 964 and the cutting implement 966. The take-up spool 950-2 is aligned and configured to receive surplus, waste or excess thermoplastic film $F_{9A}$ from the feed spool 950-1, after one or more cavities have been fabricated into the thermoplastic film $F_{9A}$, and after such cavities have been severed from the thermoplastic film $F_{9A}$ by the cutting implement 966.

As is shown in FIG. 9, the conveying system 934-1 includes a plurality of buckets or other carriers, each of which may be loaded with items and used to transport the items to a respective one of the cavities 955-1, 955-2, 955-3, 955-4, 955-5 fabricated in the thermoplastic film $F_{9A}$ by the actuator system 940. Operation of the conveying system 934-1 may be coordinated, e.g., by one or more servers or other computer systems, such that dimensions or other attributes of items included in the respective buckets may be provided to the actuator system 940 prior to or upon the buckets' arrival, thereby enabling the actuator system 940 to select one of more of the actuators provided therein, and distances by which such actuators are to be extended into the thermoplastic film $F_{9A}$, to fabricate one or more of the cavities 955-1, 955-2, 955-3, 955-4, 955-5 in the thermoplastic film $F_{9A}$, viz., the cavity 955-1, as is shown in FIG. 9, based on dimensions or other attributes of such items. Operation of the feed spool 950-1 and the take-up spool 950-2 may be further coordinated by such servers or computer systems to advance the thermoplastic film $F_{9A}$ and the cavities 955-1, 955-2, 955-3, 955-4, 955-5 fabricated therein, as necessary, to receive the items from the conveyor system 934-1. As is shown in FIG. 9, the conveyor system 934-1 may be specifically programmed or configured to deposit one or more items in a selected bucket into one of the cavities 955-1, 955-2, 955-3, 955-4, 955-5, viz., the cavity 955-2, as is shown in FIG. 9, that is specifically fabricated in the thermoplastic film $F_{9A}$ to accommodate such items.

Additionally, operations of the robotic arm 960 may be further coordinated by such servers or computer systems to deposit one or more items into one or more of the cavities 955-1, 955-2, 955-3, 955-4, 955-5, viz., the cavity 955-3, or to manipulate one or more items that have been deposited into one or more of the cavities, such as is shown in FIG. 9, or to ensure that such items are aligned in acceptable orientations within such cavities 955-1, 955-2, 955-3, 955-4, 955-5. Operations of the printer 962 may also be coordinated by such servers or computer systems to cause a packing slip, a receipt or another relevant document to be printed in a timely manner, thereby enabling such documents to be inserted into one of the cavities 955-1, 955-2, 955-3, 955-4, 955-5, viz., the cavity 955-3, as is shown in FIG. 9, along with one or more items.

Operations of the feed spool 950-3 may also be coordinated by such servers or computer systems to provide one or more layers or sheets of a film $F_{9B}$, or another cover, to be applied over one or more of the cavities 955-1, 955-2, 955-3, 955-4, 955-5, viz., the cavity 955-4, as is shown in FIG. 9. Operations of the sealing system 964 may also be coordinated by such servers or computer systems to seal the one or more layers or sheets of the film $F_{9B}$, or the other cover, over one or more of the cavities 955-1, 955-2, 955-3, 955-4, 955-5, viz., the cavity 955-4, as is shown in FIG. 9.

Operations of the cutting implement 966 may be further coordinated by such servers or computer systems to sever one or more of the cavities 955-1, 955-2, 955-3, 955-4, 955-5, viz., the cavity 955-5, as is shown in FIG. 9, from the thermoplastic film $F_{9A}$ after items have been deposited into a cavity, and a cover has been provided over the cavity. After one or more of the cavities 955-1, 955-2, 955-3, 955-4, 955-5, viz., the cavity 955-5, have been severed from the thermoplastic film $F_{9A}$, as is shown in FIG. 9, the cavity may drop onto the conveyor system 934-2, which may cause the cavity to be transported elsewhere for delivery to an ultimate destination by any mode of transit.

Although some embodiments of the present disclosure describe the fabrication of cavities from thermoformed films and the packaging of items in such cavities within a fulfillment center environment, those of ordinary skill in the pertinent arts will realize that the systems and methods of the present disclosure may be utilized to fabricate a cavity from thermoplastic film for any purpose and are not limited for use in fulfillment centers. Rather, the systems and methods of the present disclosure may be utilized in connection with the fabrication of packaging for any reason, which may be customized based on any information or data regarding an item that may be known, determined or predicted.

Furthermore, the systems and methods of the present disclosure are not limited to the fabrication of cavities for packaging single items. Rather, where information or data regarding a plurality of items (e.g., a bundle of such items) is known, predicted or determined, such information or data may be used to program an actuator system to cause actuators to extend into thermoplastic films by selected distances and to fabricate cavities for such items accordingly.

It should be understood that, unless otherwise explicitly or implicitly indicated herein, any of the features, characteristics, alternatives or modifications described regarding a particular embodiment herein may also be applied, used, or incorporated with any other embodiment described herein, and that the drawings and detailed description of the present disclosure are intended to cover all modifications, equivalents and alternatives to the various embodiments as defined by the appended claims. Moreover, with respect to the one or more methods or processes of the present disclosure described herein, including but not limited to the flow charts shown in FIG. 3 or 8A and 8B, orders in which such methods or processes are presented are not intended to be construed as any limitation on the claimed inventions, and any number of the method or process steps or boxes described herein can be combined in any order and/or in parallel to implement the methods or processes described herein. Additionally, it should be appreciated that the detailed description is set forth with reference to the accompanying drawings, which are not drawn to scale. In the drawings, the use of the same or similar reference numbers in different figures indicates the same or similar items or features. Except where otherwise noted, left-most digit(s) of a reference number identify a figure in which the reference number first appears, while two right-most digits of a reference number in a figure indicate a component or a feature that is similar to components or features having reference numbers with the same two right-most digits in other figures.

Conditional language, such as, among others, "can," "could," "might," or "may," unless specifically stated otherwise, or otherwise understood within the context as used, is generally intended to convey in a permissive manner that certain embodiments could include, or have the potential to include, but do not mandate or require, certain features, elements and/or steps. In a similar manner, terms such as "include," "including" and "includes" are generally intended to mean "including, but not limited to." Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

The elements of a method, process, or algorithm described in connection with the embodiments disclosed herein can be embodied directly in hardware, in a software module stored in one or more memory devices and executed by one or more processors, or in a combination of the two. A software module can reside in RAM, flash memory, ROM, EPROM, EEPROM, registers, a hard disk, a removable disk, a CD-ROM, a DVD-ROM or any other form of non-transitory computer-readable storage medium, media, or physical computer storage known in the art. An example storage medium can be coupled to the processor such that the processor can read information from, and write information to, the storage medium. In the alternative, the storage medium can be integral to the processor. The storage medium can be volatile or nonvolatile. The processor and the storage medium can reside in an ASIC. The ASIC can reside in a user terminal. In the alternative, the processor and the storage medium can reside as discrete components in a user terminal.

Disjunctive language such as the phrase "at least one of X, Y, or Z," or "at least one of X, Y and Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C.

Language of degree used herein, such as the terms "about," "approximately," "generally," "nearly" or "substantially" as used herein, represent a value, amount, or characteristic close to the stated value, amount, or characteristic that still performs a desired function or achieves a desired result. For example, the terms "about," "approximately," "generally," "nearly" or "substantially" may refer to an amount that is within less than 10% of, within less than 5% of, within less than 1% of, within less than 0.1% of, and within less than 0.01% of the stated amount.

Although the invention has been described and illustrated with respect to illustrative embodiments thereof, the foregoing and various other additions and omissions may be made therein and thereto without departing from the spirit and scope of the present disclosure.

What is claimed is:

1. A packaging system comprising:

an actuator system comprising:

a housing;

a first plurality of linear actuators aligned in parallel to one another within the housing; and a plurality of motors, wherein tips of each of the first plurality of linear actuators are aligned in a common plane when each of the first plurality of linear actuators is in a neutral position, and wherein each of the plurality of motors is coupled to one of the first plurality of linear actuators and configured to extend or retract the one of the first plurality of linear actuators;

a conveying system having a terminus provided downstream of the actuator system; and a computing device in communication with at least the actuator system and the conveying system, wherein the computing device is configured to at least:

determine at least one cross-sectional area of an item and a plurality of heights of the item;

select a second plurality of the linear actuators based at least in part on the at least one cross-sectional area of the item, wherein each of the second plurality of the linear actuators is one of the first plurality of the linear actuators;

select, for each of the second plurality of the linear actuators, a distance by which each of the second plurality of the linear actuators is to be extended to define a cavity for accommodating at least the item based at least in part on the plurality of heights of the item;

extend each of the second plurality of linear actuators into a thermoplastic material by the distances selected for respective ones of the second plurality of linear actuators, wherein extending each of the second plurality of linear actuators into the thermoplastic material by the distances selected for the respective ones of the second plurality of linear actuators forms the cavity within the thermoplastic material;

retract each of the second plurality of linear actuators from the cavity by at least the distances selected for the respective ones of the second plurality of linear actuators; and deposit the item into the cavity by the conveying system.

2. The packaging system of claim 1, wherein the thermoplastic material is maintained at a first temperature prior to extending each of the second plurality of linear actuators into the thermoplastic material, wherein the thermoplastic material is at a second temperature prior to retracting each of the second plurality of linear actuators from the cavity by at least the distance, and wherein the first temperature is greater than the second temperature.

3. The packaging system of claim 1, wherein the actuator system further comprises a vacuum pump disposed within the housing, wherein the vacuum pump is in communication with the computing device, and wherein the computing device is further configured to at least:

apply suction to the thermoplastic material with each of the second plurality of linear actuators extended into the thermoplastic material by the selected distances.

4. The packaging system of claim 1, further comprising a camera aligned to include at least a portion of the conveying system within a field of view, wherein the computing device is in communication with the camera, and wherein the computing device is further configured to at least:

capture, by the camera, imaging data regarding an item being transported by the conveying system;

process the imaging data to recognize at least one of an outline of the item or an identifier provided on an external surface of the item within the imaging data; and determine the at least one cross-sectional area of the item and the at least one height of the item based at least in part on at least one of the outline or the identifier.

5. A method comprising:

determining, by a computer device, at least a first dimension and a second dimension of an item, wherein the computer device is in communication with a first plurality of actuators arranged within an array, and wherein contact points of each of the first plurality of actuators are aligned in a common plane with each of the first plurality of actuators in a neutral position;

selecting, by the computer device, a second plurality of actuators based at least in part on the first dimension of the item, wherein each of the second plurality of actuators is one of the first plurality of actuators;

selecting, by the computer device, distances by which each of the second plurality of actuators is to be extended with respect to the common plane based at least in part on the second dimension of the item;

providing a thermoplastic material adjacent to the common plane;

extending each of the second plurality of actuators into the thermoplastic material by the distances selected for the respective ones of the second plurality of actuators; and retracting each of the second plurality of actuators by at least the distances selected for the respective ones of the second plurality of actuators, wherein a cavity for accommodating at least the item is formed in the thermoplastic material upon retracting each of the second plurality of actuators by at least the distances selected for the respective ones of the second plurality of actuators.

6. The method of claim 5, wherein the thermoplastic material is provided at a first temperature prior to causing each of the second plurality of actuators to be extended into the thermoplastic material by each of the selected distances, wherein the thermoplastic material is at a second temperature prior to causing each of the second plurality of actuators to be retracted from the thermoplastic material by at least each of the selected distances, and wherein the first temperature is greater than the second temperature.

7. The method of claim 5, further comprising:

capturing imaging data regarding the item by at least one imaging device;

recognizing, by the computer device, at least a portion of the item depicted within the imaging data; and determining at least the first dimension and the second dimension based at least in part on the portion of the item depicted within the imaging data.

8. The method of claim 7, wherein recognizing at least the portion of the item depicted within the imaging data comprises:

recognizing, by the computer device, at least one of an outline of at least the portion of the item, a bar code provided on at least the portion of the item, a character provided on at least the portion of the item or a symbol provided on at least the portion of the item, wherein at least the first dimension and the second dimension are determined based at least in part on the outline, the bar code, the character or the symbol.

9. The method of claim 5, wherein determining at least the first information and the second dimension of the item comprises:

receiving a three-dimensional representation of at least one surface feature of at least the item.

10. The method of claim 5, wherein the first dimension is one of a width or a length of the item, and wherein the second dimension is at least one height of the item.

11. The method of claim 10, wherein selecting the second plurality of actuators comprises:

determining a cross-sectional area of the item based at least in part on the first dimension and a third dimension of the item, wherein the third dimension of the item is one of the width or the length of the item, and wherein the second plurality of actuators are selected based at least in part on the cross-sectional area of the item.

12. The method of claim 5, further comprising:

causing, by a robotic arm in communication with the computer device, the item to be deposited into the cavity.

13. The method of claim 5, further comprising:

determining at least one attribute of the item; and defining at least one buffer zone with respect to at least a portion of the item based at least in part on the at least one attribute of the item, wherein the at least one buffer zone is defined by a cross-sectional area and at least one height, wherein at least some of the second plurality of actuators are selected based at least in part on the cross-sectional area of the at least one buffer zone, and wherein the distances by which each of the at least some of the second plurality of actuators is to be extended are selected based at least in part on the at least one height of the at least one buffer zone.

14. The method of claim 13, wherein the at least one attribute of the item is one of:

a component of the item;

a desired orientation of the item;

a face of the item;

an edge of the item;

a vertex of the item;

a handling restriction for the item; or an intended use of the item.

15. The method of claim 5, wherein each of the first plurality of actuators has a contact point at a distal end and is coupled to one of a plurality of prime movers by a shaft at a proximal end, and wherein each of the prime movers is one of a servo motor, a linear induction motor or a pneumatic cylinder.

16. The method of claim 15, wherein each of the contact points is one of:

a flat face;

a pointed tip; or a rounded end.

17. The method of claim 5, wherein the thermoplastic material comprises at least one of:

an acrylic;

a polyamide;

a polycarbonate;

a polyester;

a polyethylene;

a polylactic acid;

a polymer;

a polypropylene; or a polystyrene.

18. The method of claim 5, further comprising:

severing the cavity from a balance of the thermoplastic material.

19. A method for forming a cavity for an item by an actuator system comprising:

a housing;

a plurality of motors disposed within the housing, wherein each of the plurality of motors is in communication with a computer system; and a first plurality of actuators aligned in parallel in an array, wherein each of the actuators is coupled at a proximal end to one of the plurality of motors by a shaft and comprises a contact point at a distal end, wherein at least some of the contact points are in a common plane when each of the first plurality of actuators is in a neutral position, wherein the method comprises:

capturing at least one image of the item by at least one imaging device;

determining at least a first dimension and a second dimension of the item based at least in part on the at least one image;

selecting a second plurality of actuators based at least in part on the first dimension of the item, wherein each of the second plurality of the actuators is one of the first plurality of actuators;

selecting a distance by which each of the second plurality of actuators is to be respectively extended beyond the common plane based at least in part on the second dimension of the item;

providing a thermoplastic material adjacent to the common plane; and extending each of the second plurality of actuators into the thermoplastic material by the selected distances to form the cavity.

20. The method of claim 19, wherein determining at least the first dimension and the second dimension of the item comprises:

determining the first dimension, the second dimension and a third dimension of the item based at least in part on the at least one image, wherein the first dimension is a first one of a width or a length of the item, and wherein the third dimension is a second one of the width or the length of the item; and determining a cross-sectional area of the item based at least in part on the first dimension and the third dimension, and wherein the second plurality of actuators are selected based at least in part on the cross-sectional area of the item.

* * * * *